US011773515B2

(12) United States Patent
Estreicher et al.

(10) Patent No.: US 11,773,515 B2
(45) Date of Patent: Oct. 3, 2023

(54) SINGLE, MULTI-EFFECT, ENERGY HARVESTING AND HEAT MANAGING SPUN YARN AND MANUFACTURING METHOD THEREOF

(71) Applicant: New York Knitworks, LLC, Eastchester, NY (US)

(72) Inventors: Sidney Samuel Estreicher, Hillsborough, NJ (US); Javier Morera Llovera, Barcelona (ES); Gabor Stein, New York, NY (US); George Joseph Szekely, Dresher, PA (US)

(73) Assignee: New York Knitworks, LLC, Eastchester, NY (US)

( * ) Notice: Subject to any disclaimer, the term of this patent is extended or adjusted under 35 U.S.C. 154(b) by 0 days.

(21) Appl. No.: 17/671,616

(22) Filed: Feb. 15, 2022

(65) Prior Publication Data

US 2022/0267935 A1 Aug. 25, 2022

Related U.S. Application Data

(60) Provisional application No. 63/151,136, filed on Feb. 19, 2021.

(51) Int. Cl.

| | |
|---|---|
| ***D02G 3/04*** | (2006.01) |
| ***D02G 3/44*** | (2006.01) |
| ***D02G 3/32*** | (2006.01) |

(52) U.S. Cl.

CPC ..... *D02G 3/04* (2013.01); *D02G 3/32* (2013.01); *D02G 3/44* (2013.01); *D10B 2401/04* (2013.01); *D10B 2501/04* (2013.01)

(58) Field of Classification Search

CPC ... D02G 3/04; D02G 3/32; D02G 3/44; D10B 2401/04; D10B 2501/04

See application file for complete search history.

(56) References Cited

U.S. PATENT DOCUMENTS

| | | | |
|---|---|---|---|
| 6,855,422 | B2 | 2/2005 | Magill et al. |
| 2003/0224684 | A1 | 12/2003 | Botturi |
| 2004/0042965 | A1 | 3/2004 | Usui et al. |

(Continued)

FOREIGN PATENT DOCUMENTS

| | | | |
|---|---|---|---|
| JP | 2015148029 | A | 7/2018 |
| WO | 2007035483 | A1 | 3/2007 |

*Primary Examiner* — Shaun R Hurley

(74) *Attorney, Agent, or Firm* — Ashok Tankha

(57) ABSTRACT

A single, multi-effect, energy harvesting and heat managing spun yarn and a manufacturing method thereof are provided. The spun yarn includes a combination of a configurable number of fibers selected from a fiber that absorbs, stores, and releases heat energy through a phase change; fibers that convert heat energy or ultraviolet radiation energy into far infrared radiation (FIR) energy and radiate the FIR energy to other fibers and to one or more body parts of a user wearing a garment created from the spun yarn; a fiber that absorbs moisture and generates heat energy through an exothermic reaction; a fiber that provides heat insulation and repels moisture; a fiber with elasticity; and a fiber that conducts heat and maintains a substantially uniform temperature within the fibers. One or more fibers are positioned in a sheath formed free of a core or with at least one core in the spun yarn.

13 Claims, 10 Drawing Sheets

(56) References Cited

U.S. PATENT DOCUMENTS

| | | | | |
|---|---|---|---|---|
| 2009/0019624 | A1* | 1/2009 | Birk | D02G 3/04 2/81 |
| 2010/0299817 | A1* | 12/2010 | Zhu | D02G 3/443 524/439 |
| 2014/0165267 | A1* | 6/2014 | McKee | A41B 11/121 2/239 |
| 2016/0376747 | A1 | 12/2016 | Wang et al. | |
| 2017/0035605 | A1 | 2/2017 | Estreicher et al. | |
| 2017/0086522 | A1* | 3/2017 | Goenka | D03D 15/225 |
| 2020/0056307 | A1 | 2/2020 | Konukoglu et al. | |
| 2020/0060368 | A1 | 2/2020 | Hinds et al. | |
| 2020/0063296 | A1* | 2/2020 | Ozden | D02G 3/12 |
| 2020/0291550 | A1* | 9/2020 | Finck | D02G 3/04 |

* cited by examiner

SINGLE, MULTI-EFFECT, ENERGY HARVESTING AND HEAT MANAGING SPUN YARN AND MANUFACTURING METHOD THEREOF

CROSS-REFERENCE TO RELATED APPLICATIONS

This application claims priority to and the benefit of the provisional patent application titled "Single Multi-effect Spun Yarn for Energy Harvesting and Heat Insulation", application No. 63/151,136, filed in the United States Patent and Trademark Office on Feb. 19, 2021. The specification of the above referenced patent application is incorporated herein by reference in its entirety.

BACKGROUND

Clothing that is typically worn in cold weather or worn indoors in underheated spaces, creates a passive, cold, insulating barrier between a wearer of the clothing and the ambient environment. Although the passive, cold, insulating barrier created by the clothing reduces the body heat of the wearer from dissipating to the ambient environment, the clothing does not substantially minimize this heat loss to the ambient environment, which may result in the skin temperature of the wearer falling to a level that may not be comfortable for the wearer. Furthermore, clothing typically worn in cold weather is bulky, heavy, cumbersome, and uncomfortable, and restricts movement and physical activities of the wearer. In some conventional heat management methods, additional heat is introduced into the clothing typically worn in cold weather by using additional, relatively cumbersome devices, which restrict movement and provide discomfort to a wearer.

Some conventional multi-effect garments are created using a combination of multiple commercially available yarns of different types. These commercially available yarns of different types are knitted or woven to create an inner surface and an outer surface of a multi-effect garment. Creating these multi-effect garments using multiple commercially available yarns of different types does not provide a high degree of flexibility to fine tune the multi-effect performance of these garments. Instead of having to select multiple commercially available yarns of different types for creating a multi-effect garment, there is a need for a single, multi-effect spun yarn that provides a combined functionality of many different types of yarns for generating, storing, conducting, transferring, and radiating heat energy to maintain temperature of a user wearing a garment created using the multi-effect spun yarn, hereafter referred to as a "user", at a comfortable level. Furthermore, commercially available yarns do not provide a high degree of flexibility to attain desired fabric weights that are necessary for specific end uses.

Furthermore, in conventional approaches for manufacturing knits and wovens, placements of multiple yarns have to be individually designed for each fabric for achieving the desired heat performance, also referred to as "thermal performance", which is a complex and time-consuming process and provides no flexibility to a garment designer for styling the fabric. Thereafter, each fabric was required to be tested before proceeding with commercial level conversion of the yarns into garments. There is a need for improving fabric manufacturing processes and providing more flexibility in styling.

Hence, there is a long felt need for a single, multi-effect, energy harvesting and heat managing spun yarn and a method of manufacturing thereof, where the single, multi-effect spun yarn is configured to generate, store, conduct, transfer, and radiate heat energy through a combination of fibers of different types therein for maintaining the temperature of a user wearing a garment created using the multi-effect spun yarn at a comfortable level. Moreover, there is a need for a single, multi-effect, energy harvesting and heat managing spun yarn that provides a high degree of flexibility to fine tune a multi-effect performance of a fabric and in turn, a garment created therefrom and to fine tune its weight, that is, its yarn count, for attaining desired fabric weights that are necessary for specific end uses. Furthermore, there is a need for a single, multi-effect, energy harvesting and heat managing spun yarn that harvests energy from both a user's interaction with a garment created therefrom and the ambient environment, and converts the harvested energy into heat energy that is stored and distributed within the garment without any additional device for introducing and maintaining heat within the garment. Furthermore, there is a need for a single, multi-effect, energy harvesting and heat managing spun yarn configured for constructing a lightweight and less bulky, energy harvesting, heat generating, heat radiating, and heat managing, multi-effect woven fabric with active insulating performance, that maintains a substantially uniform temperature within the multi-effect woven fabric and between the multi-effect woven fabric and a body part, for example, skin of a user wearing a garment created therefrom.

SUMMARY

This summary is provided to introduce a selection of concepts in a simplified form that are further disclosed in the detailed description. This summary is not intended to determine the scope of the claimed subject matter.

The spun yarn and the method disclosed herein address the above-recited needs for a single, multi-effect, energy harvesting and heat managing spun yarn, herein referred to as a "single, multi-effect spun yarn", and a method of manufacturing thereof, where the single, multi-effect spun yarn is configured to generate, store, conduct, transfer, and radiate heat energy through a combination of fibers of different types therein for maintaining the temperature of a user wearing a garment created using the multi-effect spun yarn at a comfortable level. The single, multi-effect spun yarn provides a high degree of flexibility to fine tune a multi-effect performance of a fabric and in turn, a garment created therefrom and to fine tune its weight, that is, its yarn count, for attaining desired fabric weights that are necessary for specific end uses. The single, multi-effect spun yarn harvests energy from both a user's interaction with a garment created therefrom and the ambient environment, and converts the harvested energy into heat energy that is stored and distributed within the garment without any additional device for introducing and maintaining heat within the garment. Furthermore, the single, multi-effect, spun yarn is configured for constructing a lightweight and less bulky, energy harvesting, heat generating, heat radiating, and heat managing, multi-effect woven fabric with active insulating performance, that maintains a substantially uniform temperature within the multi-effect woven fabric and between the multi-effect woven fabric and a body part, for example, skin of a user wearing a garment created therefrom.

The single, multi-effect spun yarn disclosed herein comprises a combination of a configurable number of fibers spun together. The fibers are selected from multiple fibers of different types comprising: a first fiber configured to absorb, store, and release heat energy through a phase change; a second fiber configured to convert heat energy of one or more body parts of a user wearing a garment created using the multi-effect spun yarn into far infrared radiation (FIR) energy and radiate the FIR energy to other fibers in the single, multi-effect spun yarn and to one or more body parts of the user; a third fiber configured to absorb moisture from one or more body parts of the user and/or the ambient environment and generate heat energy through an exothermic reaction between the moisture and the third fiber; a fourth fiber configured to provide heat insulation and repel moisture; a fifth fiber having elasticity of a high degree; a sixth fiber configured to conduct heat and maintain a substantially uniform temperature within one of: the fibers, an entirety of the garment, and one or more parts of the garment; and a seventh fiber configured to convert ultraviolet radiation energy into FIR energy and radiate the FIR energy to other fibers and to one or more body parts of the user. The fibers of different types from which the combination of the configurable number of fibers of the single, multi-effect spun yarn are selected comprise, for example, staple fibers, recycled fibers, natural fibers, and filaments of the different types disclosed above.

In an embodiment, the configurable number of fibers in the combination is configured to be positioned in a sheath formed free of a core. In this embodiment, the sheath constitutes the single, multi-effect spun yarn. In another embodiment, the configurable number of fibers in the combination is configured to be positioned in a sheath formed with at least one core in the single, multi-effect spun yarn. For example, the configurable number of fibers in the combination is configured to be positioned in a sheath formed with one core, two cores, three cores, etc. In this embodiment, the sheath with one or more cores constitutes the single, multi-effect spun yarn. In an embodiment, the core comprises a filament selected from the above-disclosed fibers of different types, and the sheath comprises staple fibers selected from the above-disclosed fibers of types different from the type of the filament forming the core. That is, the type of the filament forming the core is different from the types of staple fibers forming the sheath. In an embodiment of the single, multi-effect spun yarn where the sheath encloses more than one core, each core is formed from a filament of a different type, which in turn, differs from the type of staple fibers forming the sheath.

The fibers in the combination of the configurable number of fibers are configured to interact with each other and with one or more body parts of the user for harvesting and managing the heat energy. The interactions between the fibers in the combination of the configurable number of fibers and between the fibers and one or more body parts of the user are configured to be tuned for optimal heat performance based on multiple selectable parameters. The selectable parameters comprise, for example, fiber type, positions of the fibers in the core and the sheath, thickness, and amount and relative percentages of the fibers in the single, multi-effect spun yarn. The single, multi-effect spun yarn is configured for knitting, weaving, and constructing a fabric for creating a garment or one or more parts of a garment. The single, multi-effect spun yarn is configured to generate, store, conduct, transfer, and radiate heat energy through the combination of the configurable number of fibers therein for maintaining the temperature of the user wearing the garment created using the multi-effect spun yarn, at a predetermined, comfortable level.

Disclosed herein is also a method for manufacturing the single, multi-effect spun yarn. The method disclosed herein comprises blending a combination of a configurable number of fibers selected from the fibers of different types disclosed above; forming a sliver comprising a bundle of the blended fibers aligned substantially parallel to each other using a sliver forming unit; imparting a twist into the formed sliver using a roving forming unit to create a roving of the blended fibers; and creating the single, multi-effect spun yarn using the created roving of the blended fibers in a yarn spinning unit. In an embodiment, the single, multi-effect spun yarn is created by forming a sheath free of a core. In another embodiment, the single, multi-effect spun yarn is created by forming a sheath with at least one core formed from a configurable number of fibers selected from the fibers of different types disclosed above. In this embodiment, the single, multi-effect spun yarn is created by forming the sheath with one core, two cores, three cores, etc. The core of the single, multi-effect spun yarn comprises a filament selected from the above-disclosed fibers of different types, and the sheath of the single, multi-effect spun yarn comprises staple fibers selected from the above-disclosed fibers of types different from the type of the filament forming the core. The fibers in the single, multi-effect spun yarn are configured to interact with each other and with one or more body parts of the user for harvesting and managing the heat energy.

The energy harvesting and heat insulation properties manifest in the single, multi-effect spun yarn through the interactions between the fibers in the single, multi-effect spun yarn and between the fibers and the body of the user. The interactions are optimally tuned for a desired performance by selecting fibers of different types, by appropriate placement of the fibers of different types in a core or a sheath of the single, multi-effect spun yarn, and by selecting thickness, amount, and relative percentages of the fiber filaments and the staple fibers used in the single, multi-effect spun yarn.

BRIEF DESCRIPTION OF THE DRAWINGS

The foregoing summary, as well as the following detailed description, is better understood when read in conjunction with the appended drawings. For illustrating the embodiments herein, exemplary constructions of the embodiments are shown in the drawings. However, the embodiments herein are not limited to the specific structures, components, and methods disclosed herein. The description of a structure, or a component, or a method step referenced by a numeral in a drawing is applicable to the description of that structure, or component, or method step shown by that same numeral in any subsequent drawing herein.

DETAILED DESCRIPTION

Figure 1A:
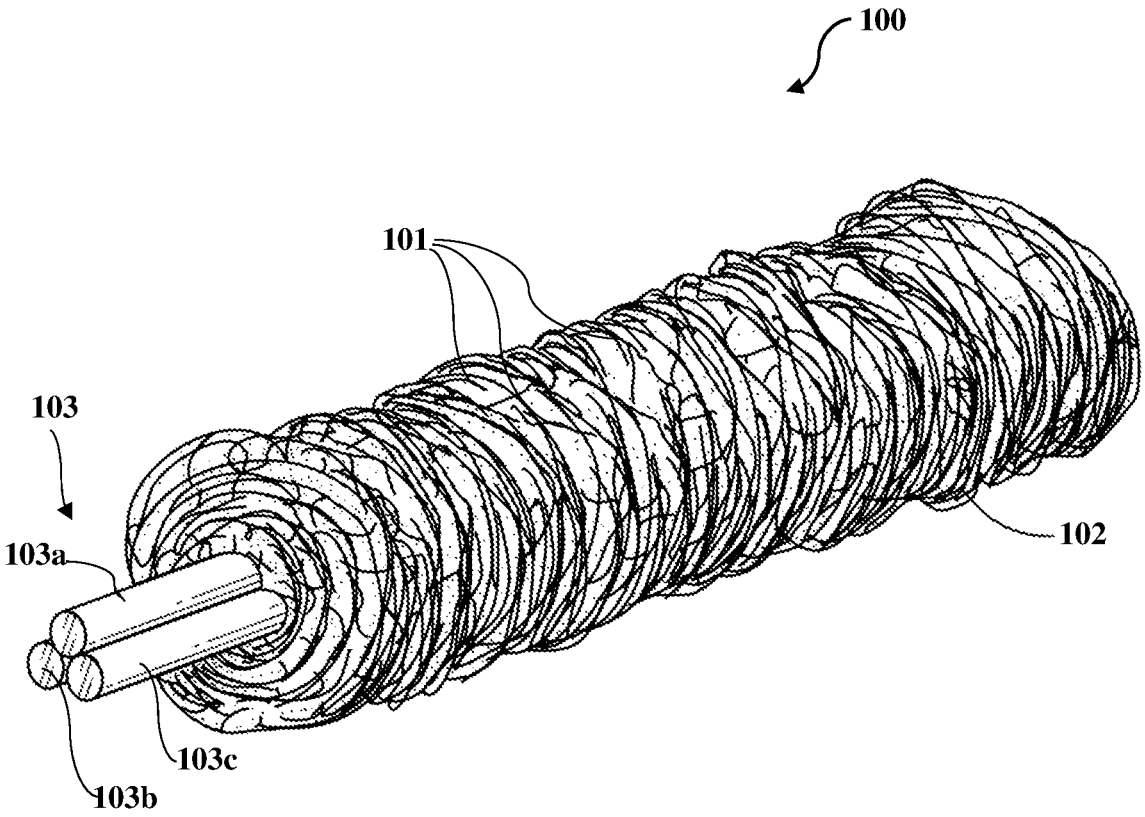
FIGS. 1A-1B exemplarily illustrate embodiments of a single, multi-effect, energy harvesting and heat managing spun yarn.
Figure 1B:
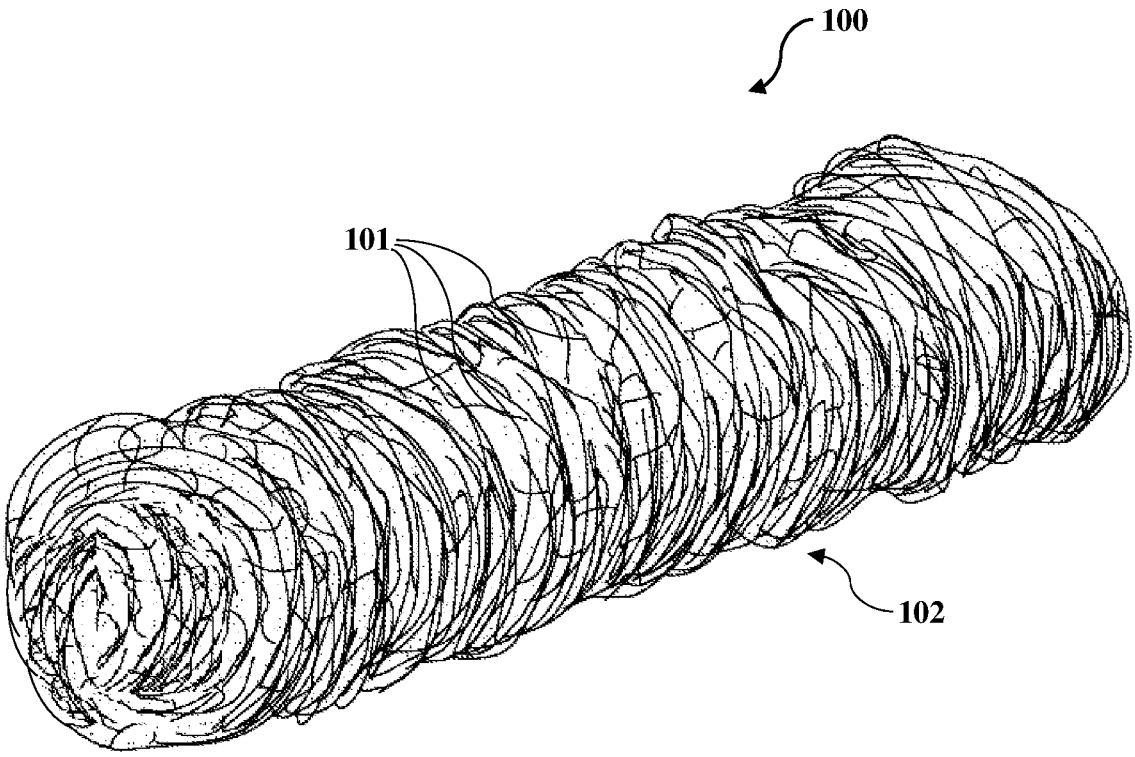

FIGS. 1A-1B exemplarily illustrate embodiments of a single, multi-effect, energy harvesting and heat managing spun yarn 100, herein referred to as a "multi-effect spun yarn". A spun yarn refers to a yarn comprising individual fibers, for example, staple fibers and filaments, placed together to form a continuous assembly of overlapping fibers that are typically bound together by a twist, for example, an S-twist or a Z-twist. The spun yarn is, therefore, made by twisting individual fibers together to create a cohesive thread. The spun yarn typically comprises a number of uneven fibers of different lengths. As used herein, "multi-effect" refers to a property of the spun yarn 100 that generates multiple effects within a fabric, and in turn, a garment created therefrom, and also on and below a body part, for example, the skin of a user wearing the garment, by combining different heat management and other functionalities, for example, heat absorption, heat release, heat generation, heat storage, conductive heat transfer, heat radiation, heat insulation, heat conduction, heat conversion, moisture absorption, water repulsion or hydrophobicity, etc., inside the spun yarn 100 and between the fabric, and in turn, the garment created therefrom and the user's skin. As used herein, the term "user" refers to a human or an animal that wears a garment created from a fabric constructed from the multi-effect spun yarn 100 disclosed herein. The multiple effects generated by the single, multi-effect spun yarn 100 comprise, for example, absorption, storage, and release of heat energy through a phase change. Multiple other effects generated by the single, multi-effect spun yarn 100 comprise, for example, conversion of heat energy from one or more body parts of the user such as the user's skin, heat energy released from fibers of the single, multi-effect spun yarn 100, and heat energy generated from the fibers of the single, multi-effect spun yarn 100 into far infrared radiation (FIR) energy, and radiation of the FIR energy to other fibers in the single, multi-effect spun yarn 100 and to one or more body parts of the user such as the user's skin.

Moreover, multiple other effects generated by the single, multi-effect spun yarn 100 comprise, for example, conversion of ultraviolet radiation energy from sunlight into FIR energy and radiation of the far infrared radiation (FIR) energy to other fibers and to one or more body parts of the user such as the user's skin. Furthermore, multiple other effects generated by the single, multi-effect spun yarn 100 comprise, for example, absorption of moisture from the user's skin and/or the ambient environment, heat generation through an exothermic process, heat insulation, moisture or water repulsion, elasticity, heat conduction, etc. Also, as used herein, "heat management" refers to control of heat energy through processes based on thermodynamics and heat transfer comprising, for example, heat conduction, convection, heat radiation, heat absorption, heat release, heat generation, heat storage, conductive heat transfer, heat insulation, heat conversion, etc., for maintaining the temperature of a user wearing a garment created using the multi-effect spun yarn 100 at a comfortable level.

The single, multi-effect spun yarn 100 disclosed herein comprises a combination of a configurable number of fibers spun together. The fibers are selected from multiple fibers of different types comprising: a first fiber, that is, a fiber of type 1, configured to absorb, store, and release heat energy through a phase change; a second fiber, that is, a fiber of type 2, configured to convert heat energy, also referred to as "thermal energy", of one or more body parts, for example, skin, of a user wearing a garment created using the single, multi-effect spun yarn 100 into far infrared radiation (FIR) energy and radiate the FIR energy to other fibers in the single, multi-effect spun yarn 100 and to one or more body parts of the user; a third fiber, that is, a fiber of type 3, configured to absorb moisture from one or more body parts of the user and/or the ambient environment and generate heat energy through an exothermic reaction between the moisture and the third fiber; a fourth fiber, that is, a fiber of type 4, configured to provide heat insulation and repel moisture; a fifth fiber, that is, a fiber of type 5, having elasticity of a high degree; a sixth fiber, that is, a fiber of type 6, configured to conduct heat and maintain a substantially uniform temperature within one of: the fibers, an entirety of the garment, and one or more parts of the garment; and a seventh fiber, that is, a fiber of type 7, configured to convert ultraviolet radiation energy from sunlight into FIR energy and radiate the FIR energy to other fibers and to one or more body parts of the user. The fibers of different types, that is, type 1, type 2, type 3, type 4, type 5, type 6, and type 7 disclosed above, from which the combination of the configurable number of fibers of the single, multi-effect spun yarn 100 is selected comprise, for example, staple fibers 101, recycled fibers, natural fibers, and filaments of the above-disclosed different types. Staple fibers 101 are fibers of discrete lengths, for example, from about several millimeters to about several tens of millimeters. The natural fibers comprise, for example, wool fibers, cotton fibers, linen fibers, silk fibers, hemp fibers, etc. Filaments are continuous fibers, that is, fibers of continuous lengths. In an embodiment, the staple fibers 101 comprise synthetic fibers produced from cut filaments. In another embodiment, the staple fibers 101 comprise natural fibers, for example, wool fibers. The functionality, structure, and/or material of the first fiber, the second fiber, the third fiber, the fourth fiber, the fifth fiber, the sixth fiber, and the seventh fiber are disclosed below.

The first fiber, that is, the fiber of type 1, is made of a phase change material for absorbing, storing, and releasing heat energy similar to a heat battery through a physical chemical process called phase change. As used herein, "phase change material (PCM)" refers to a substance that undergoes a process of phase change, for example, from a solid phase to a liquid phase and vice versa. The phase change material absorbs, stores, and releases heat energy as the phase change material oscillates between a solid phase and a liquid phase. In an embodiment, micron size droplets of paraffin or similar phase change materials that change between a liquid phase and a solid phase, are encapsulated in the first fiber to impart the phase change functionality to the first fiber. When heated, the phase change material droplets contained in the first fiber change to a liquid phase, and when cooled, the phase change material droplets contained in the first fiber change to a solid phase. Heat energy is released as the phase change material changes to a solid phase and heat energy is absorbed as the phase change material returns to a liquid phase. Phase change in the phase change material is dependent on the temperature range that is just above and just below human skin temperature. The first fiber with its phase change material stores heat generated by the user wearing a garment created from a fabric constructed from the multi-effect spun yarn 100. In an embodiment, the phase change material applied to the first fiber is in a range, for example, from about 100 microns to about 100,000 microns.

The phase change material is selected to change phase in a temperature range, for example, from about 1 degree Celsius (° C.) to about 2° C. above normal human skin temperature and about 1° C. to about 2° C. below normal human skin temperature. In an embodiment, the phase change material is selected to change phase in a temperature range, for example, from about 1° C.-10° C. above normal human skin temperature to about 1° C.-10° C. below normal human skin temperature. In an embodiment, the first fiber with its phase change material stores heat generated by the user and the third fiber. In an embodiment, the first fiber comprises phase change material bubbles encapsulated in a polymer fiber. Examples of phase change materials comprise paraffin, salt hydrates, fatty acids, esters, etc. The diameter of a phase change material bubble is, for example, about 5 micrometers (μm). In an embodiment, the phase change material is sprayed onto the first fiber. Furthermore, the phase change material in the first fiber provides a heat buffering functionality to the first fiber. The first fiber therefore functions as a heat buffer and minimizes temperature swings in the fabric and in turn, the garment created therefrom, thereby providing a substantially uniform temperature within the garment. An example of the first fiber is the Outlast® phase change fiber of Outlast Technologies, LLC, Boulder, Colo.

The second fiber, that is, the fiber of type 2, converts the heat energy of the user's body into far infrared radiation (FIR) energy and radiates the FIR energy into the other fibers of the single, multi-effect spun yarn 100 and back to the user's skin tissues, thereby providing a deep, gentle heating to the user's body. The second fiber conductively harvests the user's body heat, the heat energy from the first fiber, and the heat energy generated by the third fiber, and converts the harvested heat energy into FIR energy that radiates far infrared heat. An example of the second fiber is the NILIT® Innergy fiber of NILIT Limited Corporation, Israel. In an embodiment, the wavelength of the far infrared radiation is in a range of, for example, about 1 micrometer (μm) to about 10 μm. In another embodiment, the wavelength of the far infrared radiation as specified by the International Commission on Illumination (CIE) is in a range of, for example, about 3 μm to about 100 μm. Radiation is a method of transferring heat without relying on contact between a source of the heat, for example, the user's skin, the first fiber, the third fiber, etc., and an object, for example, the second fiber, heated by the source of the heat. Radiation transmits heat through empty space.

In an embodiment, the second fiber comprises multiple bioceramic particles. The bioceramic particles are, for example, boron-silicate minerals or tourmaline in a nanoparticle form embedded in the second fiber. The bioceramic particles are minerals with photothermal properties. The bioceramic particles produce a photothermal effect by photoexcitation of the second fiber, resulting in heat generation. The bioceramic particles emit and/or reflect far infrared thermal radiation when heated. The far infrared thermal radiation promotes molecular vibration leading to increased cellular metabolism and cell membrane permeability, thereby triggering biochemical changes that stimulate the exchange of metabolites and adenosine triphosphate (ATP) synthesis, up-regulation of chemical mediators that play a role in edema formation, pH regulation, free radicals metabolism, and microcirculation. The molecular vibration due to the far infrared radiation results in physiological effects required for a healing process, for example, pain relief, decrease of inflammatory processes, re-absorption of edema, and nerve or lymphatic vessel regeneration. Far infrared rays penetrate the user's skin and underlying tissues, and generate heat by causing subcutaneous proteins, collagens, fats, and water molecules to vibrate, elevating tissue temperatures and causing blood vessels to dilate. The improvement in blood circulation facilitates the delivery of more oxygen to the tissues, thereby providing a range of therapeutic effects.

The third fiber, that is, the fiber of type 3, generates heat energy by absorbing moisture from perspiration of the user and/or from humidity in the ambient environment. In an embodiment, the third fiber comprises desiccant type crystals, for example, silica crystals for absorbing moisture and releasing heat. The absorbed moisture and the desiccant type crystals contained in the third fiber undergo an exothermic reaction to generate heat energy. In an embodiment, the third fiber absorbs moisture from perspiration of the user's skin and/or from humidity in the ambient environment and generates heat energy through an exothermic process between the moisture and the third fiber. In an embodiment, the third fiber comprises, for example, an acrylic polymer, for absorbing moisture and releasing heat. The absorbed moisture and the acrylic polymer in the third fiber generate heat energy through an exothermic process.

In another embodiment, the third fiber is a polyacrylate fiber with moisture absorption and release characteristics. The polyacrylate fiber absorbs and releases moisture at a rapid rate, exhibits heat generating properties, and possesses antibacterial properties and flame retardancy. The chemical structure of the polyacrylate fiber yields performance characteristics that make the polyacrylate fiber suitable for use in cold weather apparel. The polyacrylate fiber comprises a long chain synthetic polymer composed of, for example, greater than about 25% by weight of acrylate units and less than about 10% by weight of acrylonitrile units. The polyacrylate fiber is an ionic polymer, and thus absorbs water vapor from the skin of the user in a substantially higher quantity and at a faster rate than other fibers. The high water absorbency of the polyacrylate fiber removes excess moisture from the user's skin, thereby providing more comfort to the user. Furthermore, by absorbing water vapor from the user's skin, the polyacrylate fiber generates heat for the user through the enthalpy of condensation, that is, by the latent heat of the water vapor released to the skin of the user upon the condensation of the water vapor in the polyacrylate fiber. Therefore, the third fiber comprising the polyacrylate fiber keeps the user substantially warmer and drier. The polyacrylate fiber also releases water at a faster rate than other fibers that allows the single, multi-effect spun yarn 100 comprising the third fiber made of the polyacrylate fiber to dry up to about three times faster than cotton garments, and substantially faster than garments constructed of other generic fibers. An example of the third fiber is the Eks® fiber of Toyobo Co., Ltd., Osaka, Japan.

The fourth fiber, that is, the fiber of type 4, is heat resistant and is hydrophobic, that is, water repellent. The fourth fiber also provides heat insulation. In an embodiment, the fourth fiber is an olefin or polypropylene fiber, with low specific gravity, low thermal conductivity, and high insulting properties. The fourth fiber is heat insulating and hydrophobic and therefore repels water to reduce entry and intrusion of unwanted ambient cold air or outside cold weather into a fabric and in turn, a garment created using the multi-effect spun yarn 100. The fourth fiber is bacteria and microorganism resistant, water resistant, fade resistant, and resistant to most acids. The heat insulating function of the fourth fiber keeps the cold out and retains warmth within a fabric constructed from the multi-effect spun yarn 100. In an embodiment, the fourth fiber removes moisture from the third fiber when the fourth fiber is in contact with the third fiber. In another embodiment, the fourth fiber is made from natural and/or synthetic raw materials. for example, wool, cashmere, polypropylene, polyester, etc. An example of the fourth fiber is the Prolen® fiber of Chemosvit Fibrochem, Štúrova, Slovakia.

In an embodiment, the fifth fiber, that is, the fiber of type 5, is a synthetic fiber made from a polyether-polyurea copolymer, originally invented at the Benger laboratory of DuPont de Nemours, Inc. The polyether-polyurea copolymer is available from multiple sources, under the generic name elastane also referred to as spandex. In another embodiment, the fifth fiber is made from a polyester-polyurethane copolymer. An example of the fifth fiber is the Lycra® fiber of the Lycra Company LLC. Another example of the fifth fiber is the ESPA® fiber of Toyobo Co., Ltd., Osaka, Japan. Another example of the fifth fiber is a 40-denier spandex. The fifth fiber is made of innumerable polymer strands that impart an elastic property to the fifth fiber. In an embodiment, the fifth fiber is configured to stretch, for example, up to about five times of its unstretched length. In an embodiment, the fifth fiber is configured to stretch, for example, up to about four times its unstretched length, when used as a yarn by itself or in conjunction with other yarns, and not as a filament core. The fifth fiber is resistant to wear and tear caused by moisture such as sweat, body oils, etc. A fabric constructed from the multi-effect spun yarn 100 comprising the fifth fiber is configured to create a garment having a snug fit on the user's body part. In an embodiment, the fifth fiber is configured to enhance heat conductivity between the body part of the user and the garment.

In an embodiment, the sixth fiber, that is, the fiber of type 6, functions to maintain a substantially uniform temperature within the combination of the configurable number of fibers in the single, multi-effect spun yarn 100 using carbon nanotube technology. The sixth fiber is, for example, a carbon nanofiber. Carbon nanofibers are seamless, cylindrical, hollow, and lightweight fibers, comprising a single sheet of pure graphite. The type of bond holding the carbon atoms together has substantial strength, and a hexagonal pattern of the carbon atoms causes a phenomenon known as electron delocalization. The carbon atoms vibrate to move heat through the nanotube structure of the carbon nanofiber, thereby providing high thermal and electrical conductivity within the single, multi-effect spun yarn 100. The thermal conductivity of the sixth fiber functions to equalize temperature distribution within the fabric and in turn, the garment created using the multi-effect spun yarn 100. The sixth fiber substantially equalizes the temperature between different parts of the garment by transferring heat from one part to another part of the garment. An example of the sixth fiber is the Miralon® fiber of Huntsman Corporation, headquartered in The Woodlands, Tex., USA.

The seventh fiber, that is, the fiber of type 7, on exposure to ultraviolet radiation, for example, ultraviolet radiation from sunlight, converts the ultraviolet radiation energy to far infrared radiation (FIR) energy and radiates the FIR energy to other fibers in the single, multi-effect spun yarn 100 and to one or more body parts of the user. The wavelength of the ultraviolet radiation is in a range of, for example, about 10 nanometers (nm) to about 380 nm. An example of the seventh fiber is the LUMITON® fiber of Lumia Group, LLC, headquartered in North Carolina, USA.

The fibers in the combination of the configurable number of fibers of the single, multi-effect spun yarn 100 are configured to interact with each other and with one or more body parts of the user for harvesting and managing the heat energy. In an embodiment, the second fiber, the third fiber, and the seventh fiber disclosed above are configured to interact with each other and with one or more body parts of the user and the ambient environment to harvest the heat energy. In another embodiment, the first fiber is configured to absorb the far infrared radiation (FIR) energy from the second fiber and the seventh fiber and receive the heat energy from the third fiber. In another embodiment, the first fiber, in conjunction with the sixth fiber having a high heat conductivity, is configured to maintain a substantially uniform temperature within the fibers of the single, multi-effect spun yarn 100. In another embodiment, the second fiber is further configured to harvest the heat energy from one or more body parts of the user, the heat energy from the first fiber, and the heat energy from the third fiber through conduction. In another embodiment, the second fiber is further configured to harvest the heat energy from one or more body parts of the user, the heat energy from the first fiber, and the heat energy from the third fiber through radiation.

In an embodiment of the single, multi-effect spun yarn 100, the configurable number of fibers in the combination is configured to be positioned in a sheath 102 formed free of a core 103 in the single, multi-effect spun yarn 100 as exemplarily illustrated in FIG. 1B. In this embodiment, the sheath 102 constitutes the single, multi-effect spun yarn 100. For example, the single, multi-effect spun yarn 100 comprises a sheath 102 made of staple fibers 101 selected from a combination of three fibers of different types, namely, the second fiber, the third fiber, and the fourth fiber disclosed above, free of a core 103. The single, multi-effect spun yarn 100 in this example, therefore, provides a combined functionality of the three fibers of type 2, type 3, and type 4 as disclosed above, and therefore has properties of (1) converting heat energy of one or more body parts of a user wearing a garment created using the multi-effect spun yarn 100 into far infrared radiation (FIR) energy and radiating the FIR energy to the third fiber and the fourth fiber in the single, multi-effect spun yarn 100 and to one or more body parts of the user; (2) absorbing moisture from one or more body parts of the user and/or the ambient environment and generating heat energy through an exothermic reaction; and (3) providing heat insulation and repelling moisture, to maintain the temperature of the user wearing the garment created using the multi-effect spun yarn 100 at a comfortable level.

In another embodiment of the single, multi-effect spun yarn 100, the configurable number of fibers in the combination is configured to be positioned in a sheath 102 formed with at least one core 103 in the single, multi-effect spun yarn 100 as exemplarily illustrated in FIG. 1A. For example, the configurable number of fibers in the combination is configured to be positioned in a sheath 102 formed, for example, with one core, two cores, three cores 103*a*, 103*b*, and 103*c*, etc. In this embodiment, the sheath 102 with one or more cores 103*a*, 103*b*, and 103*c* constitutes the single, multi-effect spun yarn 100. The core 103 is, for example, less than about one third of the overall weight of the single, multi-effect spun yarn 100. In an embodiment, the single, multi-effect spun yarn 100 is a core spun yarn, where the core 103 comprises a filament selected from the above-disclosed fibers of different types, and the sheath 102 comprises staple fibers 101 selected from the above-disclosed fibers of types different from the type of filament forming the core 103. That is, the type of filament forming the core 103 is different from the types of staple fibers 101 forming the sheath 102. The sheath 102 comprising the staple fibers 101 completely wraps around the central filament core 103. In an example, the single, multi-effect spun yarn 100 disclosed herein comprises a sheath 102 formed from a combination of three staple fibers 101 such as the second fiber, the third fiber, and the fourth fiber, enclosing a core 103 comprising a filament made of the first fiber disclosed above. The single, multi-effect spun yarn 100 in this example, therefore, provides a combined functionality of the four fibers of type 1, type 2, type 3, and type 4 as disclosed above, and therefore has properties of (1) absorbing, storing, and releasing heat energy through a phase change; (2) converting heat energy of one or more body parts of a user wearing a garment created using the multi-effect spun yarn 100 into far infrared radiation (FIR) energy and radiating the FIR energy to the first fiber, the third fiber, and the fourth fiber in the single, multi-effect spun yarn 100 and to one or more body parts of the user; (3) absorbing moisture from one or more body parts of the user and/or the ambient environment and generating heat energy through an exothermic reaction; and (4) providing heat insulation and repelling moisture, to maintain the temperature of the user wearing the garment created using the multi-effect spun yarn 100 at a comfortable level.

In an example, the single, multi-effect spun yarn 100 disclosed herein comprises a sheath 102 formed from a combination of three staple fibers 101 such as the second fiber, the third fiber, and the fourth fiber, enclosing a core 103 comprising a filament made of the fifth fiber disclosed above. The single, multi-effect spun yarn 100 in this example, therefore, provides a combined functionality of the four fibers of type 2, type 3, type 4, and type 5 as disclosed above, and therefore has properties of (1) converting heat energy of one or more body parts of a user wearing a garment created using the multi-effect spun yarn 100 into far infrared radiation (FIR) energy and radiating the FIR energy to the third fiber, the fourth fiber, and the fifth fiber in the single, multi-effect spun yarn 100 and to one or more body parts of the user; (2) absorbing moisture from one or more body parts of the user and/or the ambient environment and generating heat energy through an exothermic reaction; and (3) providing heat insulation and repelling moisture, to maintain the temperature of the user wearing the garment created using the multi-effect spun yarn 100 at a comfortable level; as well as (4) providing a high degree of elasticity to a fabric and in turn, the garment created therefrom by increasing fabric flexibility and improving the fabric texture, drape, crease recovery ability, non-deformability characteristics, durability, and wearability.

In another example, the single, multi-effect spun yarn 100 disclosed herein comprises a sheath 102 formed from a combination of three staple fibers 101 such as the second fiber, the third fiber, and the fourth fiber, enclosing two cores comprising two filaments made of the first fiber and the fifth fiber. The single, multi-effect spun yarn 100 in this example, therefore, provides a combined functionality of the five fibers of type 1, type 2, type 3, type 4, and type 5 as disclosed above, and therefore has properties of (1) absorbing, storing, and releasing heat energy through a phase change; (2) converting heat energy of one or more body parts of a user wearing a garment created using the multi-effect spun yarn 100 into far infrared radiation (FIR) energy and radiating the FIR energy to the first fiber, the third fiber, the fourth fiber, and the fifth fiber in the single, multi-effect spun yarn 100 and to one or more body parts of the user; (3) absorbing moisture from one or more body parts of the user and/or the ambient environment and generating heat energy through an exothermic reaction; and (4) providing heat insulation and repelling moisture, to maintain the temperature of the user wearing the garment created using the multi-effect spun yarn 100 at a comfortable level; as well as (5) providing a high degree of elasticity to a fabric and in turn, the garment created therefrom by increasing fabric flexibility and improving the fabric texture, drape, crease recovery ability, non-deformability characteristics, durability, and wearability.

In another example, the single, multi-effect spun yarn 100 disclosed herein comprises a sheath 102 formed from a combination of three staple fibers 101 such as the second fiber, the third fiber, and the fourth fiber, enclosing three cores 103*a*, 103*b*, and 103*c* comprising three filaments as exemplarily illustrated in FIG. 1A. That is, each core 103*a*, 103*b*, or 103*c* is formed from a single filament. In an example, the first fiber, the fifth fiber, and the sixth fiber are selected as the three filaments forming the three cores 103*a*, 103*b*, and 103*c* of the single, multi-effect spun yarn 100 respectively. The single, multi-effect spun yarn 100 in this example, therefore, provides a combined functionality of the six fibers of type 1, type 2, type 3, type 4, type 5, and type 6 as disclosed above, and therefore has properties of (1) absorbing, storing, and releasing heat energy through a phase change; (2) converting heat energy of one or more body parts of a user wearing a garment created using the multi-effect spun yarn 100 into far infrared radiation (FIR) energy and radiating the FIR energy to the first fiber, the third fiber, the fourth fiber, the fifth fiber, and the sixth fiber in the single, multi-effect spun yarn 100 and to one or more body parts of the user; (3) absorbing moisture from one or more body parts of the user and/or the ambient environment and generating heat energy through an exothermic reaction; (4) providing heat insulation and repelling moisture to maintain the temperature of the user wearing the garment created using the multi-effect spun yarn 100 at a comfortable level; (5) providing a high degree of elasticity to a fabric and in turn, the garment created therefrom; and (6) conducting heat and maintaining a substantially uniform temperature within the fibers, the entirety of the garment created therefrom, and/or one or more parts of the garment.

In an embodiment, the single, multi-effect spun yarn 100 disclosed herein comprises a sheath 102 formed from a combination of staple fibers 101, enclosing a single core comprising more than one filament that are pre-twisted together. For example, the single, multi-effect spun yarn 100 disclosed herein comprises a sheath 102 formed from a combination of three staple fibers 101 such as the second fiber, the third fiber, and the fourth fiber, enclosing a single core comprising three filaments that are pre-twisted together. In an example, the first fiber, the fifth fiber, and the sixth fiber are selected as the three filaments pre-twisted together to form the single core of the single, multi-effect spun yarn 100. The single, multi-effect spun yarn 100 in this example, therefore, provides a combined functionality of the six fibers of type 1, type 2, type 3, type 4, type 5, and type 6 as disclosed above, and therefore has properties of (1) absorbing, storing, and releasing heat energy through a phase change; (2) converting heat energy of one or more body parts of a user wearing a garment created using the multi-effect spun yarn 100 into far infrared radiation (FIR) energy and radiating the FIR energy to the first fiber, the third fiber, the fourth fiber, the fifth fiber, and the sixth fiber in the single, multi-effect spun yarn 100 and to one or more body parts of the user; (3) absorbing moisture from one or more body parts of the user and/or the ambient environment and generating heat energy through an exothermic reaction; (4) providing heat insulation and repelling moisture to maintain the temperature of the user wearing the garment made from the multi-effect spun yarn 100 at a comfortable level; (5) providing a high degree of elasticity to a fabric and in turn, the garment created therefrom; and (6) conducting heat and maintaining a substantially uniform temperature within the fibers, the entirety of the garment created therefrom, and/or one or more parts of the garment. In other embodiments, the single, multi-effect spun yarn 100 disclosed herein comprises a sheath 102 formed from a combination of staple fibers 101, enclosing more than one core, where each core comprises more than one filament that are pre-twisted together.

Figure 2:
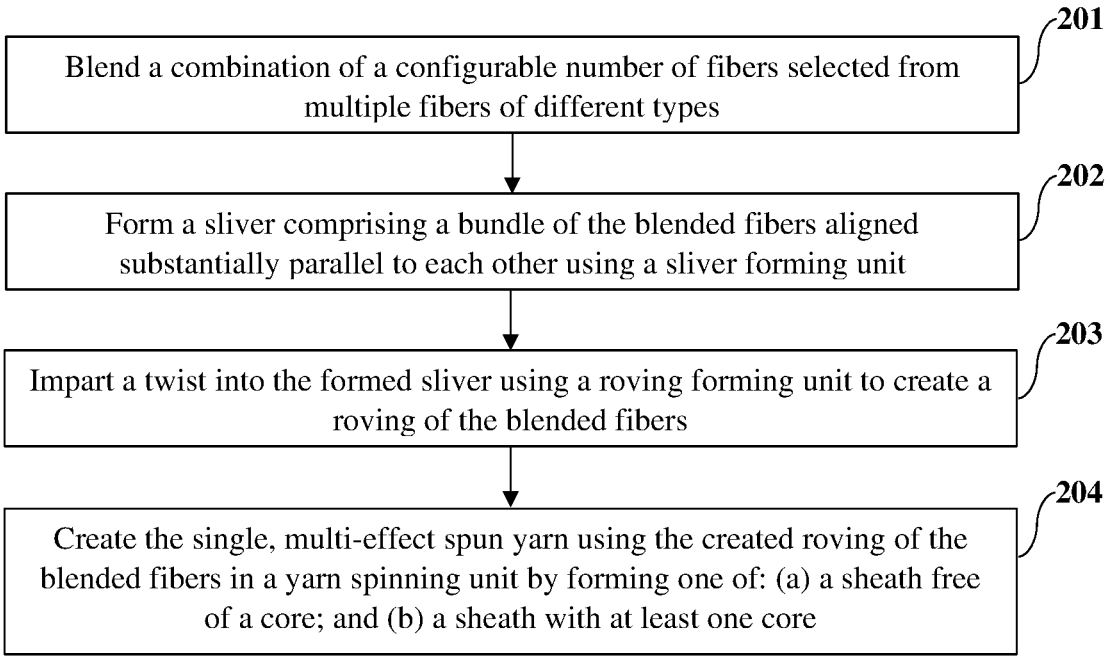
FIG. 2 illustrates a flowchart of a method for manufacturing a single, multi-effect, energy harvesting and heat managing spun yarn.

The interactions between the fibers in the combination of the configurable number of fibers in the single, multi-effect spun yarn 100 and between the fibers and one or more body parts of the user are configured to be tuned for optimal heat performance, also referred to as "thermal performance", based on multiple selectable parameters as disclosed in the description of FIG. 2. The selectable parameters comprise, for example, fiber type, positions of the fibers in the core 103 and the sheath 102, thickness, and amount and relative percentages of the fibers in the single, multi-effect spun yarn 100.

Consider an example where the single, multi-effect spun yarn 100 comprising a core 103 made of the first fiber and a sheath 102 made of the second fiber and the third fiber are twisted such that the fibers in the twisted bundle of fibers interact with each other and with the user's skin, when the user wears a garment created using the multi-effect spun yarn 100. The second fiber receives heat energy conductively from the user's skin and from the first fiber and converts this heat energy into far infrared radiation (FIR) energy. This conversion shows transfer of heat by conduction and radiation. This FIR energy penetrates below the user's skin, and by exciting water molecules in the user's body generates gentle heat. In an embodiment, the phase change material of the first fiber absorbs the FIR energy, thus delaying the phase change by staying warmer longer. The first fiber stores the heat energy in the embedded phase change material. The heat energy maintains the absorption process in the third fiber by delaying the time to reach equilibrium. The third fiber absorbs moisture at ambient pressure and ambient temperature. When the third fiber receives heat energy, moisture absorbed is desorbed and escapes from the surface of the third fiber. The third fiber cools after the desorption of the moisture. The processes of absorption and desorption are thermodynamically reversible processes. The third fiber is configured to start the absorption anew. The heat energy received by the third fiber and the heat energy generated by the third fiber are used conductively in different methods. In a first method, the heat energy generated by the third fiber is used conductively by touching the user's skin. In a second method, by touching the first fiber, the third fiber transfers the generated heat energy to the phase change material of the first fiber, which stores the heat energy. In a third method, the third fiber transfers the generated heat energy to the second fiber, which converts this heat energy into FIR energy. In an embodiment, two or more of the first fiber, the second fiber, and the third fiber in the twisted bundle of fibers receive the heat energy from each other and from the skin of the user and conductively transfer the heat energy to each other and to the skin of the user.

Consider another example where the single, multi-effect spun yarn 100 comprising a core 103 made of the first fiber and a sheath 102 made of the second fiber, the third fiber, the fourth fiber, and the sixth fiber are twisted such that the fibers in the twisted bundle of fibers interact with each other and with the skin of a hand of a user wearing a garment created using the multi-effect spun yarn 100. The second fiber receives heat energy conductively from the user's skin and from the first fiber and converts this heat energy into far infrared radiation (FIR) energy. This conversion shows a transformation and transfer of heat from conductivity to radiation. This FIR energy penetrates below the user's skin, and by exciting water molecules in the user's body generates gentle heat. In an embodiment, the phase change material of the first fiber absorbs the FIR energy, thus delaying the phase change by staying warmer longer. The first fiber stores the heat energy in the embedded phase change material. The heat energy maintains the absorption process in the third fiber by delaying the time to reach equilibrium. The third fiber absorbs moisture based on ambient pressure and ambient temperature. When the third fiber receives heat, moisture absorbed is desorbed and escapes from the surface of the third fiber. The fourth fiber, being hydrophobic, carries the moisture escaped away from the third fiber. The third fiber cools after the desorption of the moisture. The processes of absorption and desorption are thermodynamically reversible processes. The third fiber is configured to start the absorption anew. This heat energy and the heat energy generated by the third fiber are used conductively in different methods. In a first method, the heat energy generated by the third fiber is used conductively by touching the user's skin. In a second method, by touching the first fiber, the third fiber transfers the generated heat energy to the phase change material of the first fiber, which stores the heat energy. In a third method, the third fiber transfers the generated heat energy to the second fiber, which converts this heat energy into FIR energy. The sixth fiber is a carbon nanofiber that functions to maintain a substantially uniform temperature within the combination of the first fiber, the second fiber, the third fiber, and the fourth fiber in the single, multi-effect spun yarn 100.

The single, multi-effect spun yarn 100 is configured for knitting, weaving, and constructing a fabric for creating a garment or one or more parts of a garment. In an example, the single, multi-effect spun yarn 100 is configured for knitting, weaving, and constructing a denim fabric for creating a garment such as denim jeans, with only the fifth fiber in the core 103 and the first fiber in a staple form in the sheath 102. The single, multi-effect, spun yarn 100 is configured for constructing a lightweight and less bulky, energy harvesting, heat generating, heat radiating, and heat managing, multi-effect woven fabric with active insulating performance, that maintains a substantially uniform temperature within the multi-effect woven fabric and between the multi-effect woven fabric and a body part, for example, skin of a user wearing a garment created therefrom.

In an embodiment, the multi-effect woven fabric is constructed using a lengthwise or longitudinal warp that is held stationary in tension on a frame or a loom, while a transverse weft is drawn through and inserted over and under the warp. In the multi-effect woven fabric disclosed herein, one or more yarns are used in the warp and another one or more yarns are used in the weft, during weaving of the multi-effect woven fabric. In an embodiment, the single, multi-effect spun yarn 100 disclosed herein is used in the weft, while other commercially available yarns are used in the warp, for constructing the multi-effect woven fabric. In another embodiment, the single, multi-effect spun yarn 100 disclosed herein is used in the warp, while other commercially available yarns are used in the weft for constructing the multi-effect woven fabric. In another embodiment, the single, multi-effect spun yarn 100 disclosed herein is used in both the warp and the weft for constructing the multi-effect woven fabric. A weaving loom, for example, a Dobby loom, a Jacquard loom, etc., holds the warps under tension to facilitate interweaving of the wefts for construction of the multi-effect woven fabric. The weaving loom weaves the multi-effect woven fabric in one of different patterns, for example, a plain weave pattern, a twill weave pattern, a satin weave pattern, a basketweave pattern, a Jacquard pattern, a Dobby pattern, a poplin pattern, an Oxford pattern, a pin-point Oxford pattern, a chambray pattern, a denim pattern, a Leno pattern, a royal Oxford pattern, a herringbone pattern, an end-on-end pattern, etc. The yarns of the multi-effect woven fabric comprising the single, multi-effect spun yarn 100, are woven in close proximity to adjacent yarns in a repeating pattern. The repeating pattern of weaving of the multi-effect woven fabric with the yarns comprising the single, multi-effect spun yarn 100 in close proximity to each other, increases the effectiveness of the interactions between the yarns and the interactions between the yarns and the user's skin.

Interactions between the fibers of the single, multi-effect spun yarn 100 and interactions between the multi-effect woven fabric constructed from the multi-effect spun yarn 100 and the user's skin provide the multi-effect property and function and the active insulating performance to the multi-effect woven fabric. As used herein, "active insulating performance" refers to a function of the single, multi-effect spun yarn 100 and in turn, the multi-effect woven fabric, that insulates the user's skin from cold air of the ambient environment. The single, multi-effect spun yarn 100 in the multi-effect woven fabric reduces heat energy transfer between the user's skin and the ambient environment, generates heat energy, stores heat energy, and uses multiple concurrent heat transfer methods to utilize the generated heat energy, which when working in concert with the other heat generating and heat conserving functions of the other fibers in the single, multi-effect spun yarn 100, provide the active insulating performance.

The multi-effect woven fabric constructed from the multi-effect, spun yarn 100 is lightweight and less bulky than conventional winter clothing. The multi-effect woven fabric is used for creating garments of different types that cover the user's entire body or a part of the user's body, for example, the user's torso, the user's foot, the user's hand, or any other part of the user's body. Examples of garments that can be created using the multi-effect woven fabric comprise shirts, blouses, dresses, scarves, slacks, skorts, skirts, denim jeans, denim jackets, jackets, jacket linings, windbreakers, coats, coat linings, socks, gloves, underwear, long underwear, stockings, leggings, headgear, sweaters, slacks, etc., or other types of garments that can be worn on the user's body part to provide optimal temperature to the user. In an embodiment, the multi-effect woven fabric is stitched to form one or more parts of a garment. The multi-effect woven fabric is used for manufacturing lightweight and less bulky clothing for use in cold weather and indoors in underheated spaces.

The single, multi-effect spun yarn 100 provides a high degree of flexibility to fine tune a multi-effect performance of the multi-effect woven fabric and in turn, a garment created therefrom and to fine tune its weight, that is, its yarn count, for attaining desired fabric weights that are necessary for specific end uses as disclosed in the description of FIG. 2. The single, multi-effect spun yarn 100 is configured to generate, store, conduct, transfer, and radiate heat energy through the combination of the configurable number of fibers therein for maintaining the temperature of the user wearing the garment created using the multi-effect spun yarn 100 at a predetermined, comfortable level as exemplarily illustrated in FIGS. 4A-4B and FIGS. 5A-5B.

The multi-effect heat transfer and the active insulating performance of the single, multi-effect spun yarn 100 and the multi-effect woven fabric constructed therefrom are achieved by interactions between the fibers in the multi-effect spun yarn 100 and between the multi-effect woven fabric and the user's skin, as a result of the combination of at least two of several different fiber configurations of the multi-effect spun yarn 100 in the entire garment or in specific areas of the garment. Due to the relative positions of the fibers to each other, the multi-effect spun yarn 100 maximizes interplay between the fibers, and between the fibers and the user's skin. In an embodiment, the first fiber absorbs far infrared radiation energy in the range of, for example, about 3 μm to about 100 μm from the second fiber, and the first fiber conductively receives heat energy from the third fiber by physical contact with the third fiber. The first fiber with the heat buffering effect of the phase change material, in conjunction with the second fiber and/or the sixth fiber having a high heat conductivity, maintains a substantially uniform temperature within the combination of the configurable number of fibers. The second fiber and the third fiber interact with each other and with the user's body part and/or the ambient environment to harvest heat energy from the interactions with each other and with the user's body part and/or the ambient environment. The second fiber provides a deep, gentle heating to the user's body part by radiating the far infrared radiation energy that radiates far infrared heat into the other fibers, and also back to the skin of the user's body part. The hydrophobic property and structure of the fourth fiber remove moisture when the fourth fiber is in contact with the third fiber, thereby allowing the exothermic process between the moisture and the acrylic polymer in the third fiber to progress without reaching equilibrium or saturation.

The combination of the configurable number of specific fibers in the multi-effect spun yarn 100 and in turn, in the multi-effect woven fabric constructed therefrom results in energy harvesting, heat generation, and active heat management comprising conductive heat transfer and radiation, all self-contained within the multi-effect woven fabric. The specific fibers in the combination of the configurable number of fibers in the multi-effect spun yarn 100 and in turn, in the multi-effect woven fabric, interact with each other and with the user and the ambient environment. The effect of all the processes performed by the fibers in the multi-effect spun yarn 100 together, for example, generation of heat energy by an exothermic process, the conductive use of the heat energy by transferring the heat energy to the user and to the other fibers, conversion of the heat energy into far infrared radiation energy, storage of the heat energy, absorption, heat insulation, moisture removal, etc., results in heat generation and energy harvesting and in the development of a heat management system in the multi-effect woven fabric constructed from the multi-effect spun yarn 100 that functions without requiring any other external energy source or heating device in the multi-effect woven fabric.

The single, multi-effect spun yarn 100 disclosed herein is a self-heat generating system as the multi-effect spun yarn 100 harvests or scavenges energy both from the multi-effect spun yarn's 100 interaction with its user and from the outside environment, and converts this harvested energy into heat, which is stored and distributed within the fibers of the single, multi-effect spun yarn 100. The active heat management of the single, multi-effect spun yarn 100 is self-generated with no additional device, for example, a heat cartridge, microwaveable gels, a battery, a charger, etc., required for maintaining heat generated within the multi-effect spun yarn 100 and in turn, the multi-effect woven fabric constructed therefrom. In an embodiment, this self-generating, active heat management of the single, multi-effect spun yarn 100 is accomplished by combining at least three fibers of different types, selected from the fibers of the seven different types disclosed above, each performing the function of generating, storing, and distributing heat, respectively. The energy harvesting, heat generating, and heat managing effects of the single, multi-effect spun yarn 100 are achieved by the interaction of the fibers in the single, multi-effect spun yarn 100 with the user and/or the ambient environment, and with another physically adjacent fiber due to the method of construction of the multi-effect woven fabric. The combination of the configurable number of fibers in the single, multi-effect spun yarn 100 and the specific construction of the multi-effect woven fabric made from the single, multi-effect spun yarn 100 provide warmth to the user wearing the multi-effect woven fabric in cold weather.

FIG. 2 illustrates a flowchart of a method for manufacturing a single, multi-effect, energy harvesting and heat managing spun yarn 100 shown in FIGS. 1A-1B. The method disclosed herein comprises blending 201 a combination of a configurable number of fibers selected from multiple fibers of different types disclosed in the description of FIGS. 1A-1B; forming 202 a sliver comprising a bundle of the blended fibers aligned substantially parallel to each other using a sliver forming unit 309 exemplarily illustrated in FIG. 3B; imparting 203 a twist into the formed sliver using a roving forming unit 315 exemplarily illustrated in FIG. 3C, to create a roving of the blended fibers; and creating 204 the single, multi-effect spun yarn 100 using the created roving of the blended fibers in a yarn spinning unit 335 exemplarily illustrated in FIG. 3D, as disclosed in the description of FIGS. 3A-3D. In an embodiment, the fibers of different types comprise staple fibers, recycled fibers, natural fibers, and filaments of the different types disclosed in the description of FIGS. 1A-1B. In step 201 of the method disclosed herein, the selected fibers, for example, staple fibers 101 of different types such as type 2, type 3, and type 4 disclosed in the description of FIGS. 1A-1B, and of different lengths, thicknesses, diameters, etc., in different percentages are combined by a blending process performed, for example, in a blowroom section of a spinning mill, to form a mixture also referred to as a blend.

Figure 3A:
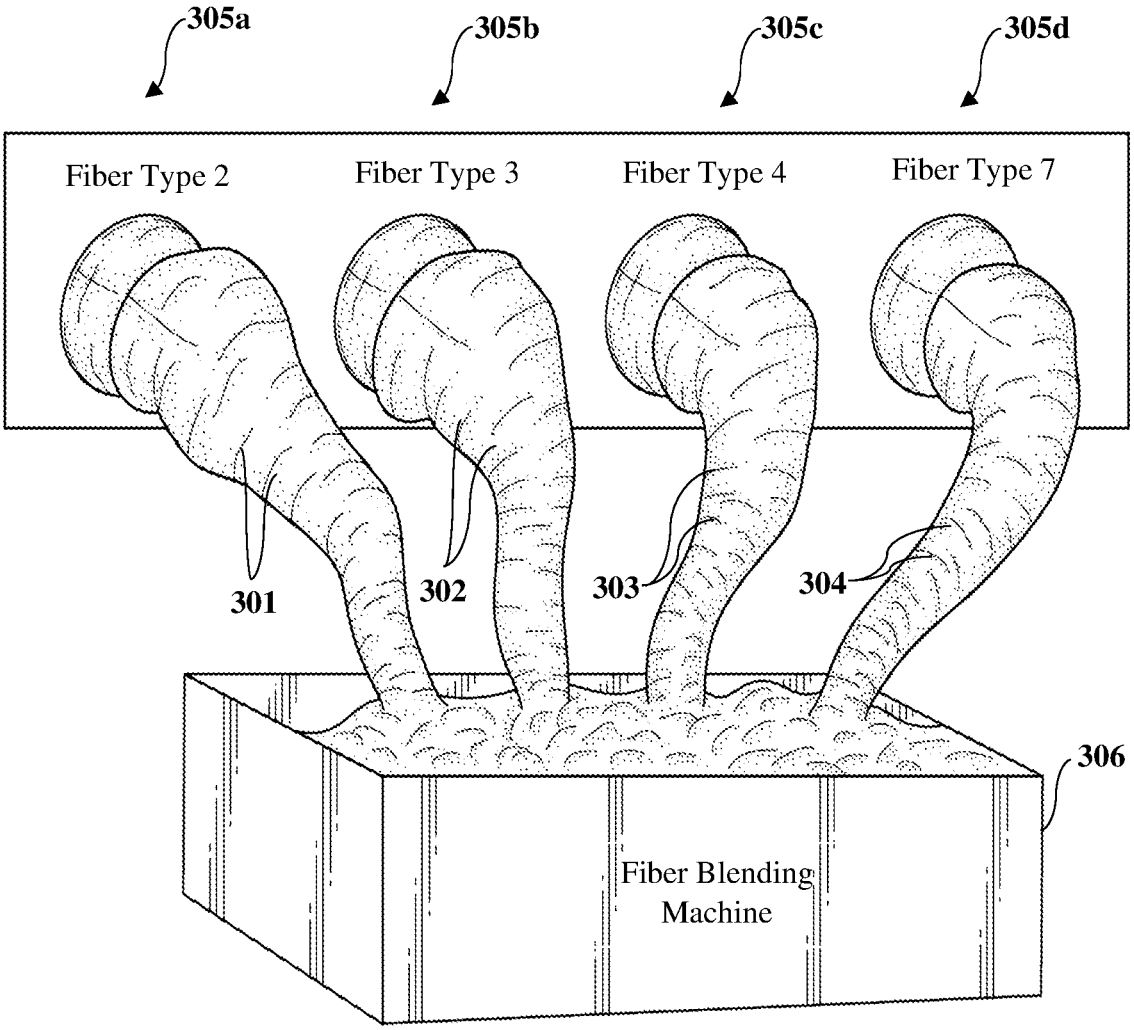
FIGS. 3A-3D exemplarily illustrate schematics showing different units of an embodiment of a system for manufacturing a single, multi-effect, energy harvesting and heat managing spun yarn.
Figure 3B:
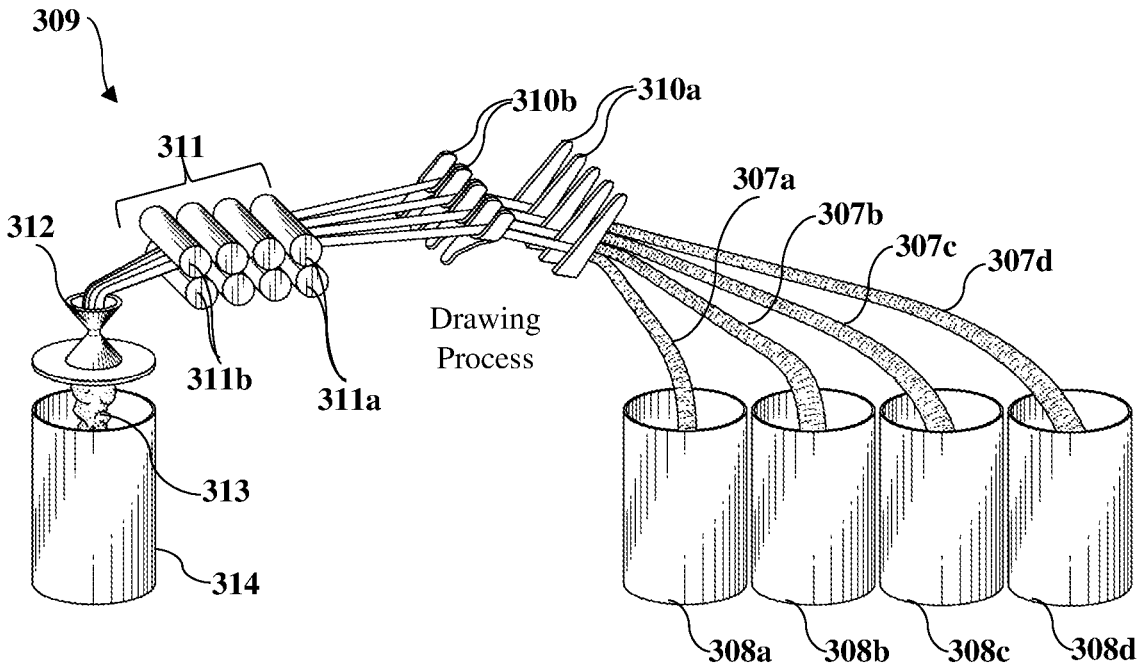

In an embodiment, the blending process is performed by bale mixing before the selected fibers enter the blowroom. In another embodiment, the blending process is performed by flock blending within the blowroom. In various embodiments, the blending process is performed at different process stages of the yarn manufacturing process using various methods, equipment, machines, etc. In an embodiment, multiple bales comprising the selected fibers are conveyed to a bale opener (not shown). The bale opener opens, separates, and detangles clumps of the selected fibers. In an embodiment, the detangled fibers are conveyed to rotating cylinders with teeth-like pins, also referred to as pinned rollers, for separating and preparing the detangled fibers for further processing, where the detangled fibers are cleaned by removing dust, dirt, broken seeds, foreign matter, etc., from the fibers, scoured, and dried. The bale opener outputs a fluffy, clump-free mass of the selected fibers, ready for blending in step 201 of the method disclosed herein. In an embodiment, the bale opener passes the mass of the selected fibers gradually through different cleaning machines for further cleaning the fibers. A fiber blending machine 306 exemplarily illustrated in FIG. 3A, is used for blending the mass of the selected fibers, the output of which is fed to the sliver forming unit 309 for forming a sliver in step 202 of the method disclosed herein.

The sliver is an elongated bundle of fibers formed, for example, by carding and optionally combing the fibers, which are thereafter drawn into elongate strips of parallel fibers. Carding is a process of reducing an entangled mass of fibers to a web by working the fibers, for example, between closely spaced pinned rollers. The sliver forming unit 309, for example, a carding machine such as a drum carder, forms the sliver comprising a bundle of the blended fibers aligned substantially parallel to each other. In the carding machine, the blended mass of the selected fibers is fed into a series of pinned rollers, for example, via a conveyor. The carding machine individually separates the fibers from each other by performing a series of dividing and redividing steps, that causes the fibers to lie parallel to each other, while removing residual impurities in the fibers. The carding machine, therefore, aligns the fibers in a parallel orientation, which in an embodiment, converts the blended mass of the selected fibers into a continuous web that is drawn together to form the sliver. To create a fine single, multi-effect spun yarn 100 in step 204 of the method disclosed herein, in an embodiment, the carding process is followed by a combing process that removes short fibres, thereby forming a sliver composed entirely of long fibres, all laid parallel, smoother, and more lustrous than uncombed fibers.

In an embodiment, the carding machine outputs a thin sheet of uniform thickness that is condensed to form a thick continuous untwisted strand called the sliver. The carding machine stores the sliver in a storage unit, for example, a drum, ready for a roving process in step 203 of the method disclosed herein. The roving process draws the sliver further and imparts a twist, for example, an S-twist, a Z-twist, etc., to the sliver to form the roving. The roving is formed using the roving forming unit 315, for example, a roving frame also referred to as a speed frame or a simplex machine. The roving forming unit 315 receives the sliver and twists the sliver down to a smaller size called the roving. In an embodiment, the roving forming unit 315 reduces the linear density of the sliver by drafting. The finished roving of the blended fibers is wound on a roving bobbin for subsequent spinning in the yarn spinning unit 335 to create the single, multi-effect spun yarn 100 in step 204 of the method disclosed herein. In various embodiments of the method disclosed herein, different spinning methods can be used for manufacturing the single, multi-effect spun yarn 100, depending on staple length of the various fibers, the diameter of such fibers, and the cost and quality of the resulting single, multi-effect spun yarn 100 to be manufactured.

In an embodiment, the single, multi-effect spun yarn 100 is created by forming a sheath 102 free of a core 103. In another embodiment, the single, multi-effect spun yarn 100 is created by forming a sheath 102 with at least one core 103 formed from a configurable number of fibers selected from the fibers of different types disclosed in the description of FIGS. 1A-1B. In this embodiment, the yarn spinning unit 335 creates the single, multi-effect spun yarn 100 by forming the sheath 102 with one core, two cores, three cores 103*a*, 103*b*, and 103*c*, etc. The core 103 of the single, multi-effect spun yarn 100 comprises a filament selected from the fibers of different types disclosed in the description of FIGS.

1A-1B, and the sheath 102 of the single, multi-effect spun yarn 100 comprises staple fibers 101 selected from the fibers of types different from the type of the filament forming the core 103 as disclosed in the description of FIGS. 1A-1B. The fibers in the single, multi-effect spun yarn 100 are configured to interact with each other and with one or more body parts of a user of a garment created using the multi-effect spun yarn 100 for harvesting and managing the heat energy as disclosed in the description of FIGS. 1A-1B.

In the method disclosed herein, the interactions between the fibers in the single, multi-effect spun yarn 100 and between the fibers and the body part(s) of the user are tuned for optimal heat performance based on multiple selectable parameters comprising, for example, fiber type, positions of the fibers in the core 103 and the sheath 102, thickness, amount and relative percentages of the fibers in the single, multi-effect spun yarn 100, etc. The yarn structure for multiple effects is created during the manufacturing process of the single, multi-effect spun yarn 100 itself, yielding a much higher degree of flexibility to fine tune the multi-effect heat management performance of the single multi-effect spun yarn 100 and the garment created therefrom. Furthermore, a much higher degree of flexibility is achieved by fine tuning the weight/count of the single multi-effect spun yarn 100. In an example, the method disclosed herein is used for manufacturing a single core, blended, multi-effect spun yarn having a metric yarns number (Nm) of 1/40 and comprising a core made from the first fiber enclosed by a sheath 102 made from the second fiber, the third fiber, and the fourth fiber. The metric yarns number, also referred to as "count", refers to a length of the single, multi-effect spun yarn in meters per 1 gram of mass. The metric yarns number indicates the linear density of the fibers in the single, multi-effect spun yarn. A metric yarns number of 1/40 means that 1000 grams or 1 kilogram (kg) of the single core, blended, multi-effect spun yarn is 40,000 meters long. Exemplary relative percentages of the fibers in the single core, blended, multi-effect spun yarn manufactured using the method disclosed herein are as follows. The core made from the first fiber constitutes, for example, about 30% by weight of the single core, blended, multi-effect spun yarn, and the sheath 102 made from the second fiber, the third fiber, and the fourth fiber constitutes, for example, about 70% by weight of the single core, blended, multi-effect spun yarn, where the sheath 102 comprises about 30% by weight of the second fiber, 15% by weight of the third fiber, and 25% by weight of the fourth fiber. The single core, blended, multi-effect spun yarn is used in the manufacture of different garments, for example, gloves, hats, socks, sweaters, base layers of underwear, lounge wear, etc., or one or more parts of different garments.

In another example, the method disclosed herein is used for manufacturing a dual core, blended, multi-effect spun yarn having a metric yarns number (Nm) of 1/20 and comprising a dual core made from the first fiber and the fifth fiber respectively, enclosed by a sheath 102 made from the second fiber, the third fiber, and the fourth fiber. Exemplary relative percentages of the fibers in the dual core, blended, multi-effect spun yarn manufactured using the method disclosed herein are as follows. The dual core made from the first fiber and the fifth fiber respectively, constitutes, for example, about 19% by weight of the dual core, blended, multi-effect spun yarn, where the dual core comprises about 15% by weight of the first fiber forming the first core and about 4% by weight of the fifth fiber forming the second core. The sheath 102 made from the second fiber, the third fiber, and the fourth fiber constitutes, for example, about 81% by weight of the dual core, blended, multi-effect spun yarn, where the sheath 102 comprises about 25% by weight of the second fiber, 15% by weight of the third fiber, and 41% by weight of the fourth fiber. In an example, the single, multi-effect spun yarn comprises about 15% by weight of a phase change fiber and about 4% by weight of a spandex fiber forming the dual core, and about 25% by weight of the far infrared energy (FIR)-radiating second fiber, about 15% by weight of acrylic fibers, and about 41% by weight of polyester fibers forming the sheath 102. The dual core, blended, multi-effect spun yarn is used in the manufacture of different garments, for example, shirts, pants, jeans, etc., or one or more parts of different garments.

In another example, the method disclosed herein is used for manufacturing a dual core, blended, multi-effect spun yarn having a metric yarns number (Nm) of 1/20 and comprising a dual core made from the first fiber and the fifth fiber respectively, enclosed by a sheath 102 made from the second fiber, the third fiber, and the fourth fiber. Exemplary relative percentages of the fibers in the dual core, blended, multi-effect spun yarn manufactured using the method disclosed herein are as follows. The dual core made from the first fiber and the fifth fiber respectively, constitutes, for example, about 19% by weight of the dual core, blended, multi-effect spun yarn, where the dual core comprises about 15% by weight of the first fiber forming the first core and about 4% by weight of the fifth fiber forming the second core. The sheath 102 made from the second fiber, the third fiber, and the fourth fiber constitutes, for example, about 81% by weight of the dual core, blended, multi-effect spun yarn, where the sheath 102 comprises about 33% by weight of the second fiber, 15% by weight of the third fiber, and 33% by weight of the fourth fiber. The dual core, blended, multi-effect spun yarn is used in the manufacture of different garments, for example, shirts, pants, jeans, etc., or one or more parts of different garments. Based on the end-use, the ratios and combinations of the fibers in each single, multi-effect spun yarn disclosed above are configurable for use in any application.

FIGS. 3A-3D exemplarily illustrate schematics showing different units 306, 309, 315, and 335 of an embodiment of a system for manufacturing a single, multi-effect, energy harvesting and heat managing spun yarn 100. Consider an example where a single, multi-effect spun yarn 100 is manufactured by forming a sheath 102 with three cores 103*a*, 103*b*, and 103*c* in a spinning mill. For purposes of illustration, the system and the method disclosed herein refer to manufacturing a single, multi-effect spun yarn 100 with three cores 103*a*, 103*b*, and 103*c*; however, the scope of the system and the method disclosed herein is not limited to manufacturing a single, multi-effect spun yarn 100 with three cores 103*a*, 103*b*, and 103*c*, but extends to the manufacture of a single, multi-effect spun yarn 100 with no core, one core, two cores, or more than three cores using a similar manufacturing process disclosed herein with no filaments or with a number of filaments less or more than three. Depending on the end use of the single, multi-effect spun yarn 100, for example, for knitting, for weaving, for use in lightweight or in heavier fabrics, etc., there may be no core, or one, or two, or three cores 103*a*, 103*b*, and 103*c*, or more than three cores with the balance of the fibers prepared in the roving 321 to make up the sheath 102. In an embodiment, recycled fibers and filaments are used for better environmental sustainability.

In this example, the sheath 102 is formed from staple fibers 301, 302, 303, and 304 of type 2, type 3, type 4, and type 7 respectively, disclosed in the description of FIGS.

1A-1B. In an embodiment, the manufacturing process begins at a blowroom of the spinning mill. The blowroom is a section of the spinning mill where multiple bales 305*a*, 305*b*, 305*c*, and 305*d* of fibers are processed by performing operations comprising, for example, bale opening, cleaning, and blending. The bales 305*a*, 305*b*, 305*c*, and 305*d* comprise dense, tangled, clumps of staple fibers 301, 302, 303, and 304, unusable fibers, extraneous matter such as dust, particulate matter, grease, dirt, etc. The blowroom comprises multiple machines operating in succession to open, clean, and blend the fibers. The operations of the blowroom convert the opened, cleaned, and blended fibers into a fiber sheet of a particular width and a substantially uniform weight per unit length.

Consider an example where staple fibers 301, 302, 303, and 304 of four different types, for example, types 2, 3, 4, and 7 are selected for manufacturing the sheath 102 of the single, multi-effect spun yarn 100. The staple fibers 301 of type 2 are configured to convert heat energy of a body part, for example, the skin of a user wearing a garment created using the multi-effect spun yarn 100 into far infrared radiation (FIR) energy and radiate the FIR energy to other fibers, for example, 302, 303, 304, etc., in the single, multi-effect spun yarn 100 and to the user's skin. The staple fibers 302 of type 3 are configured to absorb moisture from the user's skin and/or the ambient environment and generate heat energy through an exothermic reaction between the moisture and the staple fibers 302 of type 3. The staple fibers 303 of type 4 are configured to provide heat insulation and repel moisture. The staple fibers 304 of type 7 are configured to convert ultraviolet radiation energy into FIR energy and radiate the FIR energy to the other fibers, for example, 301, 302, 303, etc., and to the user's skin.

In this example, the first stage of the manufacturing process comprises calculating predetermined percentages or blending ratios of the staple fibers 301, 302, 303, and 304 of types 2, 3, 4, and 7 respectively, to establish quantities of the individual staple fibers 301, 302, 303, and 304 required to manufacture the sheath 102 of the single, multi-effect spun yarn 100. For example, the predetermined percentages or blending ratios of the staple fibers 301, 302, 303, and 304 of types 2, 3, 4, and 7 respectively, are calculated to establish quantities of the individual staple fibers 301, 302, 303, and 304 required to manufacture a sheath 102 that constitutes about 73% of the single, multi-effect spun yarn 100, where the sheath 102 comprises about 25% by weight of the staple fibers 301 of type 2, about 15% by weight of the staple fibers 302 of type 3, about 25% by weight of the staple fibers 303 of type 4, and about 8% by weight of the staple fibers 304 of type 7. According to the blending ratios of the staple fibers 301, 302, 303, and 304 of types 2, 3, 4, and 7 respectively, four separate bales 305*a*, 305*b*, 305*c*, and 305*d* containing the staple fibers 301, 302, 303, and 304 of types 2, 3, 4, and 7 respectively, are laid out in the blowroom.

In the blowroom, the staple fibers 301, 302, 303, and 304 of types 2, 3, 4, and 7 respectively, are fed from the four separate bales 305*a*, 305*b*, 305*c*, and 305*d* respectively, into a fiber blending machine 306 as exemplarily illustrated in FIG. 3A. The fiber blending machine 306 is selected, for example, from mixers manufactured by Rieter Holding Limited Corporation, Switzerland, Truetzschler GmbH & Company KG, etc. The fiber blending machine 306 blends the calculated quantities of the individual staple fibers 301, 302, 303, and 304. The fiber blending machine 306 stores elongate bundles 307*a*, 307*b*, 307*c*, and 307*d* of the blended fibers 301, 302, 303, and 304 into four storage units 308*a*, 308*b*, 308*c*, and 308*d* respectively, as exemplarily illustrated in FIG. 3B. The storage units 308*a*, 308*b*, 308*c*, and 308*d* are, for example, drums configured to contain and store the elongate bundles 307*a*, 307*b*, 307*c*, and 307*d* of the blended fibers 301, 302, 303, and 304 respectively. The elongate bundles 307*a*, 307*b*, 307*c*, and 307*d* of the blended fibers 301, 302, 303, and 304 are then fed from the four storage units 308*a*, 308*b*, 308*c*, and 308*d* respectively, into a sliver forming unit 309, for example, a draw frame, as exemplarily illustrated in FIG. 3B.

The sliver forming unit 309 comprises guide members 310*a* and 310*b* and a group 311 of pair rollers, where each pair moves at a higher speed than a previous pair in the group 311. For example, the speed of the pair rollers 311*b* is substantially higher than the speed of the pair rollers 311*a* in the group 311. The respective elongate bundles 307*a*, 307*b*, 307*c*, and 307*d* of the blended fibers 301, 302, 303, and 304 are passed to the group 311 of pair rollers via the guide members 310*a* and 310*b*. The guide members 310*a* and 310*b* receive the elongate bundles 307*a*, 307*b*, 307*c*, and 307*d* of the blended fibers 301, 302, 303, and 304 from the respective storage units 308*a*, 308*b*, 308*c*, and 308*d* and pass the elongate bundles 307*a*, 307*b*, 307*c*, and 307*d* of the blended fibers 301, 302, 303, and 304 to the group 311 of pair rollers. The elongate bundles 307*a*, 307*b*, 307*c*, and 307*d* of the blended fibers 301, 302, 303, and 304 undergo a drawing process in the sliver forming unit 309, where in an embodiment, the elongate bundles 307*a*, 307*b*, 307*c*, and 307*d* of the blended fibers 301, 302, 303, and 304 are doubled and drafted to the required ratio.

In an embodiment, due to a high degree of unevenness in the elongate bundles 307*a*, 307*b*, 307*c*, and 307*d* of the blended fibers 301, 302, 303, and 304, operations comprising, for example, equalizing, parallelizing, blending, and dust removal are also performed in the sliver forming unit 309. In an embodiment, the elongate bundles 307*a*, 307*b*, 307*c*, and 307*d* of the blended fibers 301, 302, 303, and 304 are equalized by doubling and leveling. In the process of doubling, the four elongate bundles 307*a*, 307*b*, 307*c*, and 307*d* of the blended fibers 301, 302, 303, and 304 are combined into a single bundle that forms the sliver 313. Parallelizing comprises arranging the blended fibers 301, 302, 303, and 304 in a parallel orientation, where the blended fibers 301, 302, 303, and 304 are straightened into a parallel alignment. The group 311 of pair rollers in the sliver forming unit 309 operate against each other to perform the above-disclosed drawing operations to form the silver 313. The sliver forming unit 309 outputs a coil silver 313, that is, a soft, thick, rope-like strand comprising the blended fibers 301, 302, 303, and 304, via a funnel-shaped device called a trumpet 312, and stores the coil sliver 313 in a storage unit 314, for example, a drum as exemplarily illustrated in FIG. 3B.

Figure 3C:
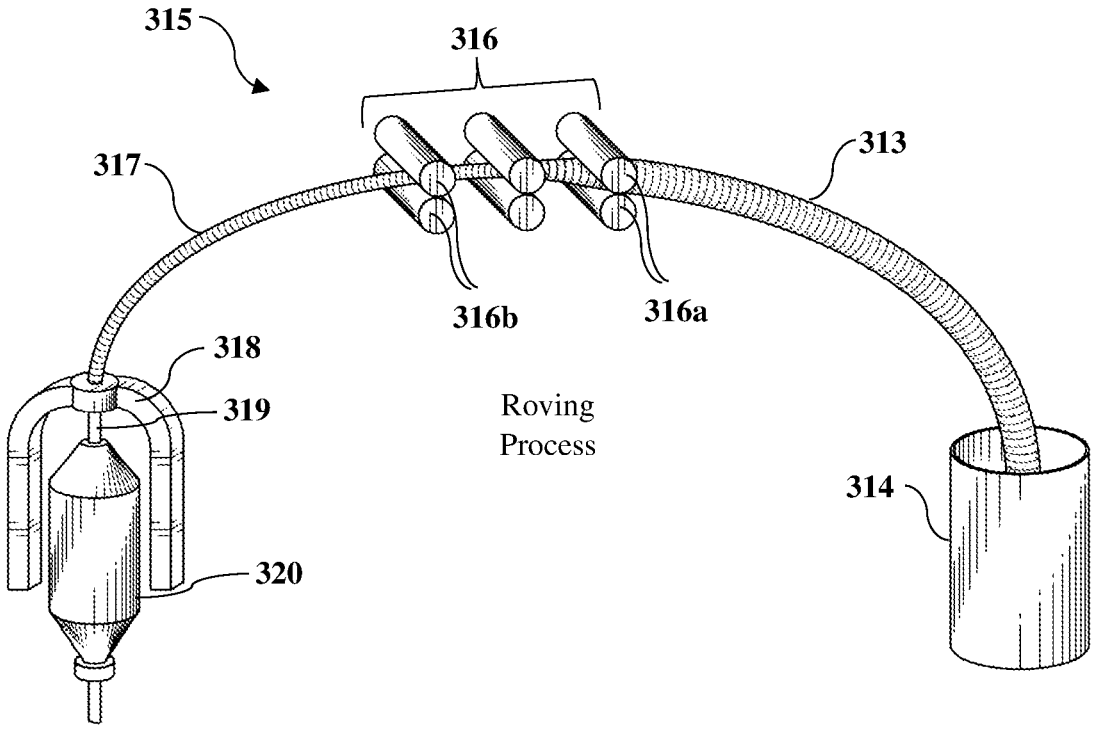

The sliver 313 in the storage unit 314 is then fed into a roving forming unit 315, for example, a roving frame, as exemplarily illustrated in FIG. 3C. The roving forming unit 315 comprises a group 316 of pair rollers, where each pair moves at a higher speed than a previous pair in the group 316. For example, the speed of the pair rollers 316*b* is substantially higher than the speed of the pair rollers 316*a* in the group 316. The group 316 of pair rollers is configured to decrease the density of the sliver 313 obtained from the sliver forming unit 309 and condense the sliver 313 into a roving 317 comprising the blended fibers 301, 302, 303, and 304. The roving 317 is passed to a roving bobbin 320 as exemplarily illustrated in FIG. 3C, through a flyer 318 configured to impart twist to the roving 317. The roving bobbin 320 is operably coupled to a spindle 319 as exemplarily illustrated in FIG. 3C. The spindle 319 rotates and facilitates winding of the roving 317 received through the flyer 318, around the roving bobbin 320. The flyer 318 rotates to impart twist, for example, a S-twist, a Z-twist, etc., to the roving 317. The finished roving 321 comprising the blended fibers 301, 302, 303, and 304 wound around the roving bobbin 320 is made available to a yarn spinning unit 335, for example, a ring frame, as exemplarily illustrated in FIG. 3D.

The yarn spinning unit 335 converts the finished roving 321 into a fine strand, herein referred to as the single, multi-effect spun yarn 100, of a desired yarn count. The finished roving 321 undergoes a drafting process in the yarn spinning unit 335. Drafting is a process of decreasing the thickness or linear density of the input material, for example, 321, 324, 325, 326, etc., by attenuation. The drafting process increases the length per unit weight of the input material, for example, 321, 324, 325, 326, etc., in accordance with the peripheral speed of rollers, for example, 322 *a*, 322 *b*, 327 *a*, 327 *b*, 327 *c*, and 328 operating in the yarn spinning unit 335. The drafting process also straightens the individual fibers in the input material, for example, 321, 324, 325, 326, etc., into parallel alignment. The drafting process also stretches the mass of fibres in the input material, for example, 321, 324, 325, 326, etc., for increasing orientation and reducing size of the mass of fibers. The finished roving 321 passes through a group of pair rollers 322 *a* and 322 *b* that rotate at different speeds. The speed of the pair rollers 322 *b* is substantially higher than the speed of the pair rollers 322 *a*. In this example, the yarn spinning unit 335 is configured to create the single, multi-effect spun yarn 100 by forming a sheath 102 with three cores, for example, core A 103 *a*, core B 103 *b*, and core C 103 *c*, where the sheath 102 is formed from the finished roving 321 comprising the blended fibers 301, 302, 303, and 304 of type 2, type 3, type 4, and type 7 respectively, and the three cores 103 *a*, 103 *b*, and 103 *c* are formed from three filaments 324, 325, and 326 respectively, selected from the fibers of different types disclosed in the description of FIGS. 1A-1B. In this example, the three cores 103 *a*, 103 *b*, and 103 *c* are formed from the filaments 324, 325, and 326 of type 1, type 5, and type 6 respectively. The filament 324 of type 1 is configured to absorb, store, and release heat energy through a phase change. The filament 325 of type 5 has a high degree of elasticity. The filament 326 of type 6 is configured to conduct heat and maintain a substantially uniform temperature within the fibers 301, 302, 303, 304, 324, and 325 and within an entirety or one or more parts of a garment created using the multi-effect spun yarn 100. The triple core comprises, for example, about 15% by weight of the filament 324 of type 1, about 4% by weight of the filament 325 of type 5, and about 8% by weight of the filament 326 of type 6, thereby constituting about 27% by weight of the single, multi-effect spun yarn 100.

Figure 3D:
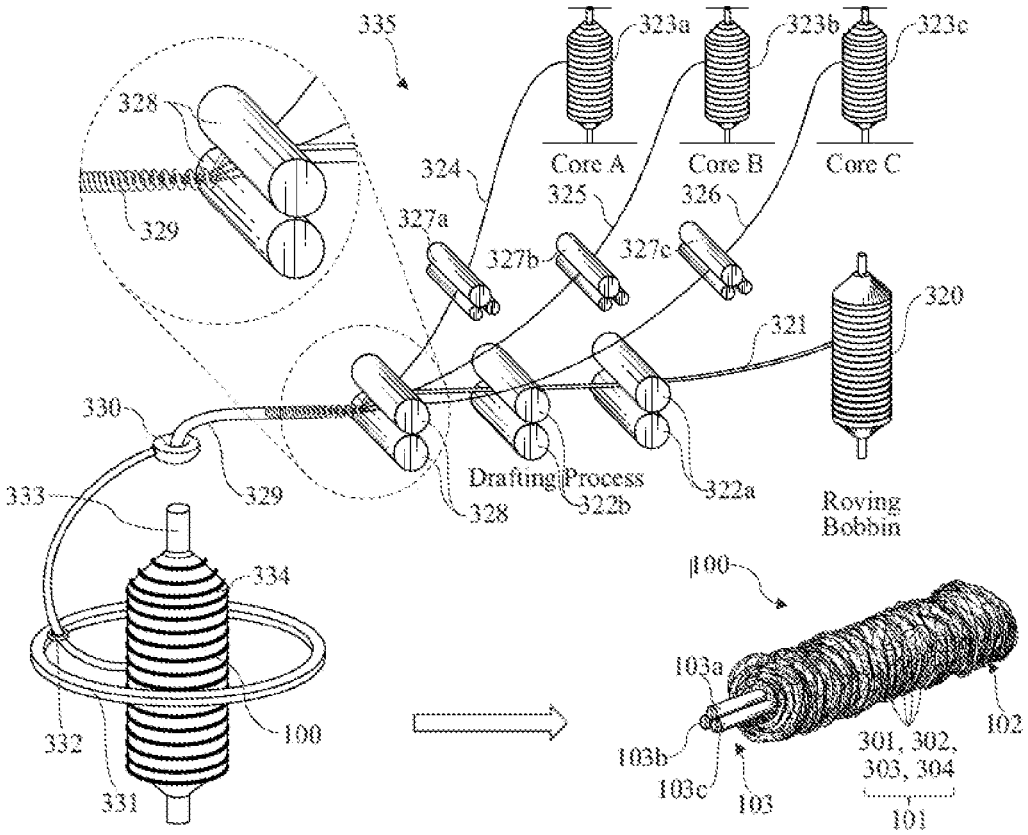

The three filaments 324, 325, and 326 of type 1, type 5, and type 6 are wound around core bobbins 323*a*, 323*b*, and 323*c* respectively, as exemplarily illustrated in FIG. 3D. In the drafting process, the three filaments 324, 325, and 326 are drawn from their respective core bobbins 323*a*, 323*b*, and 323*c* and passed through respective groups 327*a*, 327*b*, and 327*c* of rollers. The groups 327*a*, 327*b*, and 327*c* of rollers reduce the density of the filaments 324, 325, and 326, that is, the weight per unit length of the filaments 324, 325, and 326 respectively, and pass the drafted filaments 324, 325, and 326 to pair rollers 328. The pair rollers 328 simultaneously receive the drafted filaments 324, 325, and 326 from the groups 327*a*, 327*b*, and 327*c* of rollers and the drafted roving 321 from the pair rollers 322*a* and 322*b*. The pair rollers 328 combine and draft the drafted filaments 324, 325, and 326 and the drafted roving 321 to create a combined yarn element 329 for spinning into the single, multi-effect spun yarn 100 according to a required yarn count. The pair rollers 328 assemble the staple fibers 301, 302, 303, and 304 in the roving 321 and the filaments 324, 325, and 326 constituting the core A 103*a*, the core B 103*b*, and the core C 103*c*. An enlarged view of the combined yarn element 329 output from the pair rollers 328 is exemplarily illustrated in FIG. 3D.

The yarn spinning unit 335 further comprises a yarn guide 330, a spinning ring element 331 with a traveler 332, a spindle 333, and a ring bobbin 334. The spindle 333 holds the ring bobbin 334. After the drafting process, the yarn spinning unit 335 performs a ring spinning process, where the combined yarn element 329 passes through the traveler 332 that revolves at the spinning ring element 331 around the rotating ring bobbin 334 at a substantially high speed. The yarn guide 330 guides the combined yarn element 329 for winding around the ring bobbin 334 via the traveler 332. As the spinning ring element 331 revolves around the ring bobbin 334, the traveler 332 imparts a twist to the combined yarn element 329 being wound around the ring bobbin 334, thereby creating the single, multi-effect spun yarn 100. In the single, multi-effect spun yarn 100, the staple fibers 301, 302, 303, and 304 in the roving 321 are twisted around the central filaments 324, 325, and 326 constituting the cores 103*a*, 103*b*, and 103*c* respectively. The traveler 332 revolving with the spinning ring element 331 around the ring bobbin 334 inserts one turn into the combined yarn element 329 after the completion of each revolution. The twist holds the staple fibers 301, 302, 303, and 304 and the filaments 324, 325, and 326 together in the single, multi-effect spun yarn 100 and increases strength of the single, multi-effect spun yarn 100. In the embodiment where the single, multi-effect spun yarn 100 is manufactured with only a sheath 102 free of a core 103 as exemplarily illustrated in FIG. 1B, only the finished roving 321 is passed through the pair rollers 328 for subsequent creation of a yarn element 329 for spinning into the single, multi-effect spun yarn 100 according to a required yarn count as disclosed above.

The single, multi-effect spun yarn 100 produced during the ring spinning process is wound on the ring bobbin 334 simultaneously and continuously, caused by a speed difference between the spindle 333 and the traveler 332. The traveler 332 rotates at a slower speed than the spindle 333. The traveler 332 and the spindle 333 together facilitate the winding of the single, multi-effect spun yarn 100 on the ring bobbin 334. The length of the single, multi-effect spun yarn 100 wound on the ring bobbin 334 corresponds to the difference in peripheral speeds of the spindle 333 and the traveler 332. Since the traveler 332 does not have its own drive, the traveler 332 is dragged along behind by the spindle 333.

In an embodiment, a traverse guide (not shown) is attached to the spinning ring element 331 which facilitates the movement of the single, multi-effect spun yarn 100 upwards and downwards along the length of the ring bobbin 334. The traverse motion of the single, multi-effect spun yarn 100 makes the ring bobbin 334 substantially uniform and prevents the entanglement of the single, multi-effect spun yarn 100 during its unwinding. The upward and downward movement of the traverse guide is controlled, for example, by means of a cam. One or more motors (not shown) are used to run the yarn spinning unit 335.

A cutaway view of the single, multi-effect spun yarn 100 is also exemplarily illustrated in FIG. 3D. As exemplarily illustrated in FIG. 3D, the single, multi-effect spun yarn 100 comprises a sheath 102 comprising the selected fibers 101, that is, the staple fibers 301, 302, 303, and 304 of types 2, 3, 4, and 7 respectively, and three cores 103*a*, 103*b*, and 103*c* comprising the filaments 324, 325, and 326 of type 1, type 5, and type 6 respectively, within the sheath 102. The single, multi-effect spun yarn 100, therefore, provides the combined properties and functionalities of the staple fibers 301, 302, 303, and 304 of type 2, type 3, type 4, and type 7 respectively, and the filaments 324, 325, and 326 of type 1, type 5, and type 6 respectively as disclosed above. By fiber composition in this example, the single, multi-effect spun yarn 100 comprises about 73% by weight of the sheath 102 and about 27% by weight of the triple core 103.

The single, multi-effect spun yarn 100 comprising fibers of seven different types as disclosed above is exemplarily referred to as an "all-in-one" multi-effect spun yarn 100. For purposes of illustration, the system and the method disclosed herein refer to manufacturing a single, "all-in-one" multi-effect spun yarn 100 comprising fibers of seven different types; however, the scope of the system and the method disclosed herein is not limited to manufacturing a single, "all-in-one" multi-effect spun yarn 100 comprising fibers of seven different types, but extends to the manufacture of a single, multi-effect spun yarn 100 comprising a combination of a configurable number of fibers of at least two different types, for example, of two types, three types, four types, five types, or six types for achieving an optimal multi-effect performance. A manufacturer may select any number of filaments and staple fibers for the core 103 and the sheath 102 respectively, based on the manufacturer's requirement. In an embodiment, the selection does not include all the seven types of staple fibers and filaments. The single, multi-effect spun yarn 100 generates, stores, conducts, transfers, and radiates heat energy through the combination of the staple fibers 301, 302, 303, and 304 in the sheath 102 and the combination of the filaments 324, 325, and 326 in the cores A 103*a*, B 103*b*, and C 103*c* respectively, therein for maintaining the temperature of the user wearing a garment created using the multi-effect spun yarn 100 at a predetermined comfortable level.

Figure 4A:
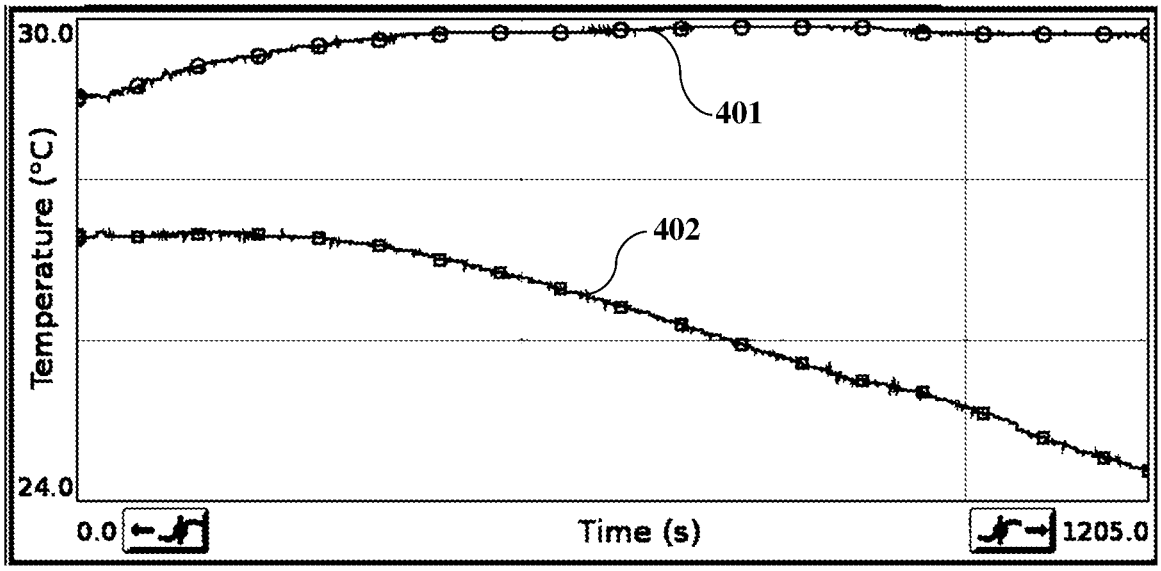
FIGS. 4A-4C exemplarily illustrate graphical representations showing heat performance of a multi-effect garment created using the multi-effect, energy harvesting and heat managing spun yarn against a reference garment.
Figure 4B:
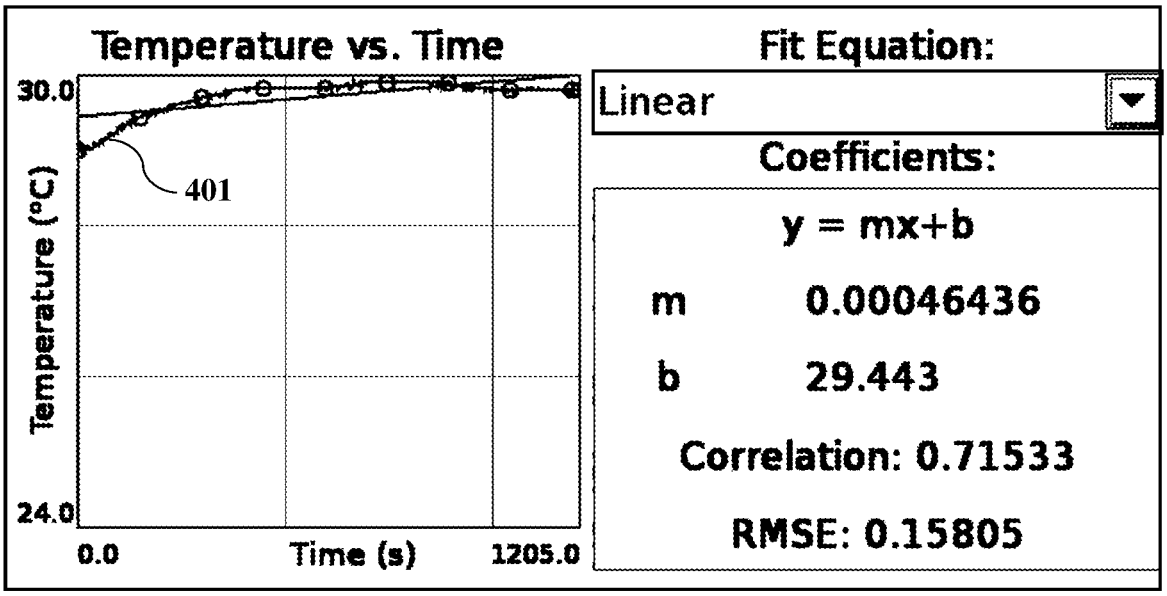
Figure 4C:
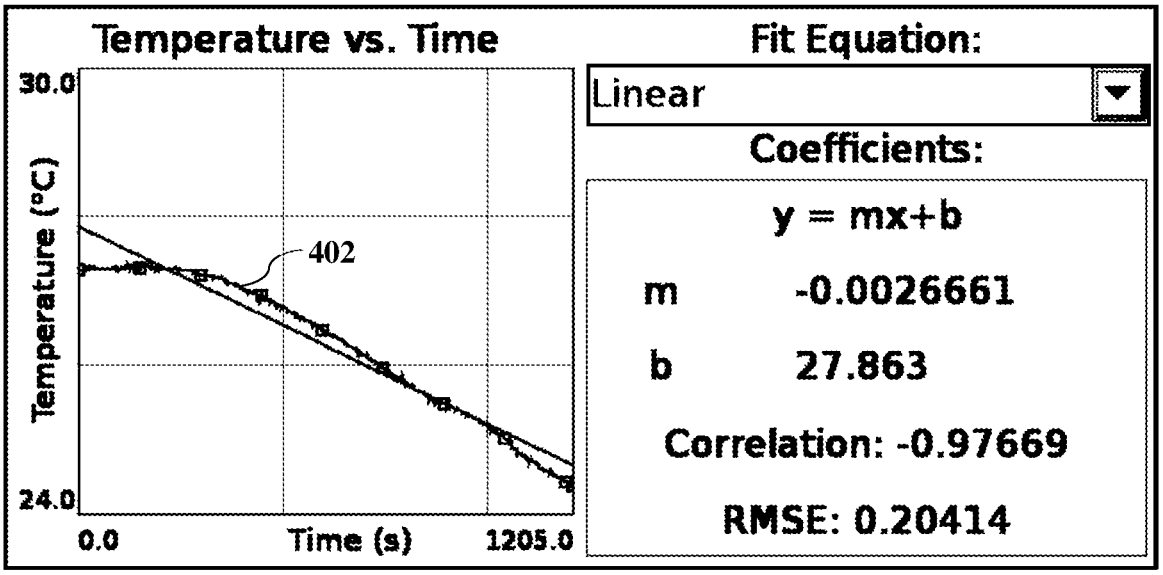

FIGS. 4A-4C exemplarily illustrate graphical representations showing heat performance of a multi-effect garment created using the multi-effect, energy harvesting and heat managing spun yarn against a reference garment. Consider an example of a multi-effect garment such as a multi-effect sock where parts of the multi-effect sock such as a toes section, a heel section, and a bottom section of a midfoot part are created from a multi-effect woven fabric constructed from the multi-effect spun yarn disclosed herein, while the remaining parts of the sock are made from fabric materials such as polyester (PES) and a percentage, for example, about 2% to about 8% by weight of spandex. In an example of the multi-effect sock, the parts of the sock constructed from the multi-effect spun yarn disclosed herein comprise about 85% by weight of polyester fibers and about 15% by weight of acrylic fibers.

In another embodiment, a multi-effect garment is created for use in medical applications. In an example, the multi-effect medical garment comprises parts constructed from the multi-effect spun yarn comprising polyester fibers and acrylic fibers, while the remaining parts of the multi-effect medical garment comprise, for example, about 15% by weight of spandex fibers. In this example, overall, the multi-effect medical garment constructed from the multi-effect spun yarn comprises about 70% by weight of polyester fibers, about 15% by weight of acrylic fibers, and about 15% by weight of spandex fibers. For purposes of illustration, the detailed description refers to a sock as being the multi-effect garment created using the multi-effect spun yarn; however the scope of the system and the method disclosed herein is not limited to manufacturing a multi-effect sock, but extends to manufacturing other multi-effect garments using the multi-effect spun yarn, for example, a glove to be worn on a user's hand, an undergarment, a T-shirt, pants, jeans, or any other type of garment that can be worn on the user's body part, for example, hands, feet, legs, torso, or any other part of the user's body to provide heat to the user.

In an example of the multi-effect garment, the metric yarns number (Nm) is 1/40. In the multi-effect garment herein, 40 meters of the single, multi-effect spun yarn in the multi-effect garment weigh 1 gram. The metric yarns number of 1/40 indicates a single metric 40 equivalent to 225 denier, or 250 Decitex (Dtex), or 23.6 English cotton count (ECC). By yarn construction, the single, multi-effect spun yarn in this example comprises a single core made from a filament of type 1 disclosed in the description of FIGS. 1A-1B, enclosed by a sheath made from three staple fibers of type 2, type 3, and type 4 disclosed in the description of FIGS. 1A-1B. The fiber composition of the single, multi-effect spun yarn in this example comprises about 30% by weight of the filament of type 1 for the single core, and about 30% by weight of the staple fibers of type 2, about 15% by weight of the staple fibers of type 3, and about 25% by weight of the staple fibers of type 4 for the sheath.

In this example, the heat performance of the multi-effect garment was tested against a reference garment such as a regular, commercially available sock made of about 95% by weight of polyester and about 5% by weight of spandex in an environmentally controlled chamber, where the ambient temperature was 5 degrees Celsius (C), that is, 41 degrees Fahrenheit (F) and the relative humidity was about 25% to about 26%. The multi-effect garment and the reference garment were worn by a user seated on a chair, in a stationary state. The user wore the multi-effect garment on the left foot and the reference garment on the right foot. To conduct the test, a temperature sensor was positioned directly on the user's skin on the tip of the user's middle toe on both the left foot and the right foot. The temperature sensor measured the temperature of the user's skin when the user was wearing the multi-effect garment and the reference garment. In this example, the temperature of the user's skin was measured at a frequency of 60 readings per minute, that is, one reading per second.

FIG. 4A exemplarily illustrates a graphical representation showing heat performance of the multi-effect garment against the reference garment. In the graphical representation in FIG. 4A, the upper line referenced by the numeral 401 indicates the temperature of the skin of the user wearing the multi-effect garment, over time indicated by the horizontal axis of the graphical representation, and the lower line referenced by the numeral 402 indicates the temperature of the skin of the user wearing the reference garment, over time. The horizontal axis of the graphical representation in FIG. 4A indicates the testing time from 0 seconds to 1205 seconds, that is, just over 20 minutes. As exemplarily illustrated in FIG. 4A, the combination of fibers in the single, multi-effect spun yarn having the single core made from the filament of type 1 enclosed by a sheath made from the three staple fibers of type 2, type 3, and type 4, used to create the multi-effect garment, substantially maintained the temperature of the user's skin at a comfortable level without a significant temperature decrease, while the temperature of the user's skin wearing the reference garment substantially decreased, which made the user feel cold and uncomfortable.

FIGS. 4B-4C exemplarily illustrate linear regression data plots showing quantifiable heat performance differences between the multi-effect garment and the reference garment respectively. A linear regression line has a linear equation of the form y=mx+b, where "x" is an input variable, "y" is a dependent output variable, "m" is the slope of the line, and "b" is the intercept, that is, the value of y when x=0. FIGS. 4B-4C exemplarily illustrate results of a linear regression analysis of the heat performance of the multi-effect garment and the reference garment respectively. The linear regression in FIG. 4B shows a positive slope while the linear regression in FIG. 4C shows a negative slope, which indicates an enhanced heat performance of the multi-effect garment created using the multi-effect spun yarn over the reference garment.

Figure 5A:
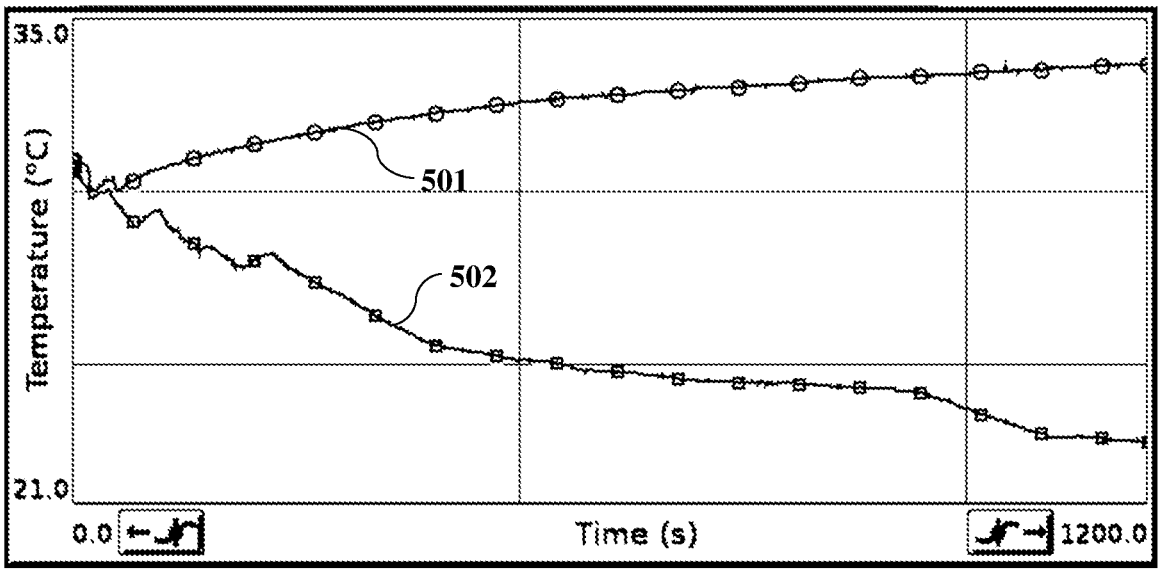
FIGS. 5A-5C exemplarily illustrate graphical representations showing heat performance of another multi-effect garment created using the multi-effect, energy harvesting and heat managing spun yarn against a reference garment.
Figure 5B:
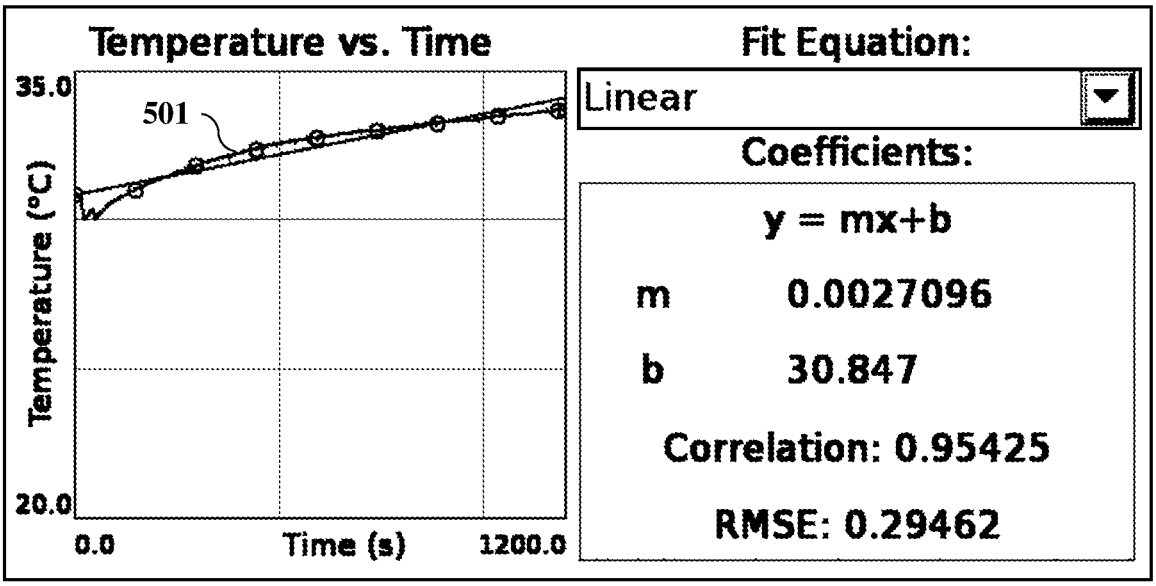
Figure 5C:
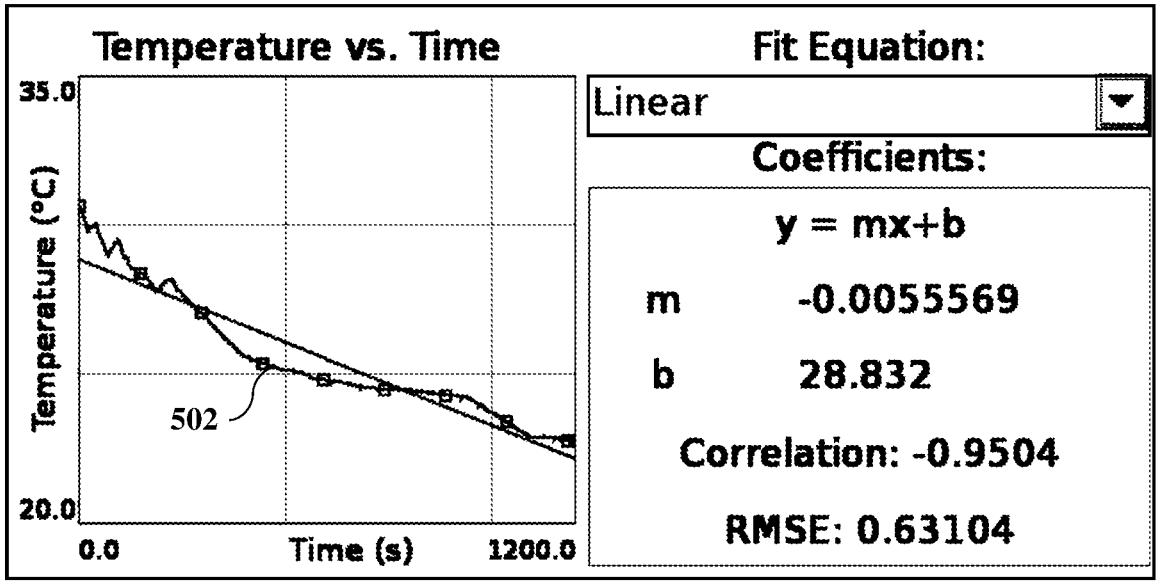

FIGS. 5A-5C exemplarily illustrate graphical representations showing heat performance of another multi-effect garment created using the multi-effect, energy harvesting and heat managing spun yarn against a reference garment. Consider an example of a multi-effect garment such as a pair of slightly tapered tube style leggings created from a multi-effect woven denim fabric constructed from the multi-effect spun yarn disclosed herein. The denim fabric is woven, for example, with a 3/1 right hand (RH) twill pattern. The right hand twill pattern is a diagonal pattern that moves from the bottom left of the fabric to the top right of the fabric. In this example, the number of threads per centimeter of the fabric used to create the multi-effect garment is 17. Furthermore, in this example, the warp of the multi-effect woven denim fabric comprises an Ne 14/1 ring carded slub 0008 with a total warp of 5832, where Ne refers to new English count, that is, the number of times the length of one pound of yarn can be divided by 840. Furthermore, the weft of the multi-effect woven denim fabric comprises the multi-effect spun yarn disclosed herein. The multi-effect garment is made with an Nm 1/20 dual core multi-effect spun yarn in the weft. In this example, the metric yarns number (Nm) is 1/20. In the multi-effect garment herein, 20 meters of the single, multi-effect spun yarn in the multi-effect garment weigh 1 gram. The metric yarns number of 1/20 indicates a single metric 20 equivalent to 450 denier, or 500 Decitex (Dtex), or 11.8 English cotton count (ECC).

By yarn construction, the single, multi-effect spun yarn in this example comprises a dual core made from filaments of type 1 and type 5 disclosed in the description of FIGS. 1A-1B, enclosed by a sheath made from three staple fibers of type 2, type 3, and type 4 disclosed in the description of FIGS. 1A-1B. By fiber composition of the weft, the single, multi-effect spun yarn in this example comprises about 15% by weight of a filament of type 1 and about 4% by weight of a filament of type 5 forming the dual core, and about 33% by weight of the staple fibers of type 2, about 15% by weight of the staple fibers of type 3, and about 33% by weight of the staple fibers of type 4 forming the sheath. For example, the single, multi-effect spun yarn comprises about 15% by weight of a phase change fiber and about 4% by weight of a spandex fiber forming the dual core, and about 33% by weight of far infrared energy (FIR)-radiating second fibers, about 15% by weight of acrylic fibers, and about 33% by weight of wool fibers forming the sheath. In an embodiment, the filament of type 1 used in the dual core and the staple fibers of type 2 used in the sheath are polyester-based fibers.

In this example, the heat performance of the multi-effect garment was tested against a reference garment such as slightly tapered tube style leggings made from a denim cotton fabric having a weight of 315 grams per square meter and a fiber composition of 98% by weight of cotton and 2% by weight of elastane. The test was conducted in an environmentally controlled chamber, where the ambient temperature was 5 degrees Celsius (C), that is, 41 degrees Fahrenheit (F) and the relative humidity was about 40% to about 45%. The multi-effect garment and the reference garment were worn by a user seated on a chair in a stationary state. The user wore the multi-effect garment on the left leg and the reference garment on the right leg. To conduct the test, temperature sensors were positioned on the user's skin directly under the respective garments and over the major leg on both the left leg and the right leg. The temperature sensors measured the temperature of the user's skin when the user was wearing the multi-effect garment and the reference garment. In this example, the temperature of the user's skin was measured at a frequency of 60 readings per minute, that is, one reading per second.

FIG. 5A exemplarily illustrates a graphical representation showing heat performance of the multi-effect garment against the reference garment. In the graphical representation in FIG. 5A, the upper line referenced by the numeral 501 indicates the temperature of the skin of the user wearing the multi-effect garment, over time indicated by the horizontal axis of the graphical representation, and the lower line referenced by the numeral 502 indicates the temperature of the skin of the user wearing the reference garment, over time. The horizontal axis of the graphical representation in FIG. 5A indicates the testing time from 0 seconds to 1200 seconds, that is, 20 minutes. As exemplarily illustrated in FIG. 5A, the combination of fibers in the single, multi-effect spun yarn having the dual core made from the filaments of type 1 and type 5 enclosed by a sheath made from the three staple fibers of type 2, type 3, and type 4, used to create the multi-effect garment, substantially maintained the temperature of the user's skin at a comfortable level without significant temperature decrease, while the temperature of the user's skin wearing the reference garment substantially decreased, which made the user feel cold and uncomfortable.

FIGS. 5B-5C exemplarily illustrate linear regression data plots showing quantifiable heat performance differences between the multi-effect garment and the reference garment respectively. Results of a linear regression analysis of the heat performance of the multi-effect garment and the reference garment are exemplarily illustrated in FIGS. 5B-5C respectively. The linear regression in FIG. 5B shows a positive slope indicated by "m" while the linear regression in FIG. 5C shows a negative slope, which indicates an enhanced heat performance of the multi-effect garment created using the multi-effect spun yarn over the reference garment.

The user's skin temperature is maintained at a comfortable level, by combining heat generation, heat storage, conductive heat transfer, and heat radiation inside the single, multi-effect spun yarn 100 exemplarily illustrated in FIGS. 1A-1B and FIG. 3D, used in a knitting or weaving process for constructing the multi-effect woven fabric of the multi-effect garment, and between such garment and its user. The multi-effect heat transfer and the active insulating performance of the single, multi-effect spun yarn 100 are achieved by (1) interactions between the fibers in the single, multi-effect spun yarn 100, as well as between the fibers and the skin of the garment's user, caused by the combination of at least two of several different fiber technologies disclosed above, in the entire garment or in specific areas of the garment; (2) the structure of the single, multi-effect spun yarn 100; and (3) the optimized heat performance of the single, multi-effect spun yarn 100. The interactions are optimally tuned for optimal heat performance by the fiber types, fiber placement in the core and/or in the sheath, thickness, and amount and relative percentages of the filaments and staple fibers used in the single, multi-effect spun yarn 100.

The single, multi-effect spun yarn 100 disclosed herein provides a high degree of flexibility to fine tune the multi-effect performance of the fabric constructed therefrom, and in turn, a garment created therefrom. Furthermore, the single, multi-effect spun yarn 100 disclosed herein provides a high degree of flexibility for attaining desired fabric weights that are necessary for specific end uses. Instead of having to select multiple commercially available yarns of different types for creating a multi-effect garment, the method disclosed herein manufactures a single, multi-effect spun yarn 100 that provides a combined functionality of many different types of yarns for generating, storing, conducting, transferring, and radiating heat energy to maintain the temperature of a user wearing the garment created using the multi-effect spun yarn 100 at a comfortable level. In the method disclosed herein, the starting point is the selection of the staple fibers and the filaments from the fibers of different types disclosed in the description of FIGS. 1A-1B, and the yarn structure for the multiple effects is created during the yarn manufacturing process itself, yielding a much higher degree of flexibility to fine tune the multi-effect heat management performance of the single multi-effect spun yarn 100 and the garment created therefrom than was previously achievable. Furthermore, a much higher degree of flexibility is achieved by fine tuning the weight/count of the single multi-effect spun yarn 100.

Furthermore, the single, multi-effect spun yarn 100 being tested at its manufacturing stage itself simplifies the construction of a fabric and in turn a garment created using the single, multi-effect spun yarn 100 and provides more flexibility to a garment designer in styling the fabric and creating the garment. The method disclosed herein allows flexible tweaking of the ratios of the fibers and filaments during the manufacture of the single, multi-effect spun yarn 100 itself, thereby allowing creation of purpose-designed multi-effect spun yarns for different applications, both as a function of the fabric manufacturing process and a function of the end market use once the fabric is converted into garments.

The foregoing examples and illustrative implementations of various embodiments have been provided merely for explanation and are in no way to be construed as limiting of the embodiments disclosed herein. Dimensions of various parts of the single, multi-effect spun yarn disclosed above are exemplary, and are not limiting of the scope of the embodiments herein. While the embodiments have been described with reference to various illustrative implementations, drawings, and techniques, it is understood that the words, which have been used herein, are words of description and illustration, rather than words of limitation. Furthermore, although the embodiments have been described herein with reference to particular means, materials, techniques, and implementations, the embodiments herein are not intended to be limited to the particulars disclosed herein; rather, the embodiments extend to all functionally equivalent structures, methods and uses, such as are within the scope of the appended claims. It will be understood by those skilled in the art, having the benefit of the teachings of this specification, that the embodiments disclosed herein are capable of modifications and other embodiments may be effected and changes may be made thereto, without departing from the scope and spirit of the embodiments disclosed herein.

We claim:

1. An all-in-one single, multi-effect spun yarn comprising fibers of seven different types, wherein the seven different types of fibers consist of:

a first fiber configured to absorb, store, and release heat energy through a phase change, wherein the first fiber is selected from a group consisting of paraffin, salt hydrates, and fatty acids;

a second fiber configured to convert heat energy of one or more body parts of a user wearing a garment created using the single, multi-effect spun yarn into far infrared radiation energy and radiate the far infrared radiation energy to other of the fibers in the single, multi-effect spun yarn and to the one or more body parts of the user, wherein the second fiber comprises multiple bioceramic particles;

a third fiber configured to absorb moisture from one or more body parts of the user and ambient environment and generate heat energy through an exothermic reaction between the moisture and the third fiber, wherein the third fiber is selected from a group consisting of silica crystals, acrylic polymer, and polyacrylate;

a fourth fiber configured to provide heat insulation, bacteria and micro-organism resistance, water resistance, fade resistance, and resistance to most acids;

a fifth fiber having elasticity of a high degree, wherein the fifth fiber comprises a synthetic fiber made from a polyether-polyurea copolymer;

a sixth fiber configured to conduct heat and maintain a substantially uniform temperature within one of: the fibers, an entirety of the garment, and one or more parts of the garment, wherein the sixth fiber is a carbon nanofiber; and a seventh fiber configured to convert ultraviolet radiation energy into far infrared radiation energy and radiate the far infrared radiation energy to other of the fibers and to one or more body parts of the user.

2. The all-in-one single, multi-effect spun yarn of claim 1, wherein the fibers are positioned in one of: (a) a sheath formed free of a core; and (b) a sheath formed with at least one core in the single, multi-effect spun yarn, wherein the fibers are configured to interact with each other and with the one or more body parts of the user for harvesting and managing the heat energy, wherein interactions between the fibers and between the fibers and the one or more body parts of the user are tuned for optimal heat performance based on selectable parameters, wherein the selectable parameters comprise fiber type, positions of the fibers in the at least one core and the sheath, thickness of the fibers, and amount and relative percentages of the fibers in the single, multi-effect spun yarn.

3. The all-in-one single, multi-effect spun yarn of claim 2, wherein the sheath formed with the at least one core is a sheath formed with one of: one core, two cores, and three cores.

4. The all-in-one single, multi-effect spun yarn of claim 1, wherein the at least one core comprises a filament selected from one or more types in the different types of fibers, and wherein the sheath comprises staple fibers selected from one or more of other types in the different types of fibers.

5. The all-in-one single, multi-effect spun yarn of claim 1, wherein the different types of fibers comprise staple fibers, recycled fibers, natural fibers, and filaments.

6. The all-in-one single, multi-effect spun yarn of claim 1, wherein the fibers are configured for one of knitting, weaving, and constructing a fabric for creating one of the garment and the one or more parts of the garment.

7. The all-in-one single, multi-effect spun yarn of claim 1, wherein the single, multi-effect spun yarn is configured to generate, store, conduct, transfer, and radiate heat energy through the fibers therein for maintaining temperature of the user wearing the garment created using the single, multi-effect spun yarn at a predetermined level.

8. A method for manufacturing an all-in-one single, multi-effect spun yarn, the method comprising:

blending seven different types of fibers, the seven different types of fibers consisting of:

a first fiber configured to absorb, store, and release heat energy through a phase change, wherein the first fiber is selected from a group consisting of paraffin, salt hydrates, and fatty acids;

a second fiber configured to convert heat energy of one or more body parts of a user wearing a garment created using the single, multi-effect spun yarn into far infrared radiation energy and radiate the far infrared radiation energy to other of the fibers in the single, multi-effect spun yarn and to the one or more body parts of the user, wherein the second fiber comprises multiple bioceramic particles;

a third fiber configured to absorb moisture from one or more body parts of the user and ambient environment and generate heat energy through an exothermic reaction between the moisture and the third fiber, wherein the third fiber is selected from a group consisting of silica crystals, acrylic polymer, and polyacrylate;

a fourth fiber configured to provide heat insulation, bacteria and micro-organism resistance, water resistance, fade resistance, and resistance to most acids;

a fifth fiber having elasticity of a high degree, wherein the fifth fiber comprises a synthetic fiber made from a polyether-polyurea copolymer;

a sixth fiber configured to conduct heat and maintain a substantially uniform temperature within one of: the fibers, an entirety of the garment, and one or more parts of the garment, wherein the sixth fiber is a carbon nanofiber; and a seventh fiber configured to convert ultraviolet radiation energy into far infrared radiation energy and radiate the far infrared radiation energy to other of the fibers and to one or more body parts of the user;

forming a sliver comprising a bundle of the blended fibers aligned substantially parallel to each other using a sliver forming unit;

imparting a twist into the formed sliver using a roving forming unit to create a roving of the blended fibers; and creating the single, multi-effect spun yarn using the created roving of the blended fibers in a yarn spinning unit by forming one of: (a) a sheath free of a core; and (b) a sheath with at least one core.

9. The method of claim 8, further comprising tuning interactions between the fibers in the single, multi-effect spun yarn and between the fibers and the one or more body parts of the user for optimal heat performance based on selectable parameters, wherein the selectable parameters comprise fiber type, positions of the fibers in the at least one core and the sheath, thickness of the fibers, and amount and relative percentages of the fibers in the single, multi-effect spun yarn.

10. The method of claim 8, wherein the creation of the single, multi-effect spun yarn in the yarn spinning unit comprises forming the sheath with one of: one core, two cores, and three cores, wherein the at least one core is formed from the different types of fibers, and wherein the fibers in the single, multi-effect spun yarn interact with each other and with the one or more body parts of the user for harvesting and managing the heat energy.

11. The method of claim 8, wherein the at least one core comprises a filament selected from one or more types in the different types of fibers, and wherein the sheath comprises staple fibers selected from one or more of other types in the different types of fibers.

12. The method of claim 8, wherein the different types of fibers comprise staple fibers, recycled fibers, natural fibers, and filaments.

13. The method of claim 8, wherein the single, multi-effect spun yarn is configured to generate, store, conduct, transfer, and radiate heat energy through the fibers therein for maintaining temperature of the user wearing the garment created using the single, multi-effect spun yarn at a predetermined level.

* * * * *